US007938089B2

(12) United States Patent
Yamamoto

(10) Patent No.: US 7,938,089 B2
(45) Date of Patent: May 10, 2011

(54) VALVE ACTUATING MECHANISM FOR AN INTERNAL COMBUSTION ENGINE, AND CYLINDER HEAD INCORPORATING SAME

(75) Inventor: Toshio Yamamoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 500 days.

(21) Appl. No.: 12/079,664

(22) Filed: Mar. 27, 2008

(65) Prior Publication Data

US 2009/0056654 A1 Mar. 5, 2009

(30) Foreign Application Priority Data

Mar. 30, 2007 (JP) ..... 2007-095091

(51) Int. Cl.
*F01L 1/34* (2006.01)

(52) U.S. Cl. ..... 123/90.16; 123/90.39; 74/569

(58) Field of Classification Search ..... 123/90.16, 123/90.39; 74/569
See application file for complete search history.

(56) References Cited

U.S. PATENT DOCUMENTS

| | | | | |
|---|---|---|---|---|
| 3,878,822 A | | 4/1975 | Beal | |
| 4,253,434 A | | 3/1981 | Takizawa et al. | |
| 4,354,460 A | | 10/1982 | Mae et al. | |
| 4,499,870 A | * | 2/1985 | Aoyama | 123/198 F |
| 4,534,323 A | | 8/1985 | Kato et al. | |
| 5,203,289 A | | 4/1993 | Hara et al. | |

FOREIGN PATENT DOCUMENTS

| | | |
|---|---|---|
| DE | 33 16446 A1 | 11/1983 |
| DE | 33 46 556 A1 | 7/1984 |
| DE | 33 15396 A1 | 10/1984 |
| DE | 195 44 242 A1 | 6/1996 |
| JP | 60-85205 | 5/1985 |
| JP | 2001-020710 | 1/2001 |

* cited by examiner

*Primary Examiner* — Zelalem Eshete
(74) *Attorney, Agent, or Firm* — Carrier Blackman & Associates, P.C.; William D. Blackman; Joseph P. Carrier

(57) ABSTRACT

A valve actuating mechanism includes a first rocker arm moving mechanism including a first spring for urging left and right rocker arms from a first operation position side towards a second operation position side. The valve actuating mechanism also includes a second rocker arm moving mechanism including a second spring for urging the left and right rocker arms from the second operation position side towards the first operation position side. When a predetermined force is applied to the left and right rocker arms by one of the respective springs, the rocker arms are configured to be moved to operation positions corresponding to the applied force.

19 Claims, 22 Drawing Sheets

FIG. 6A
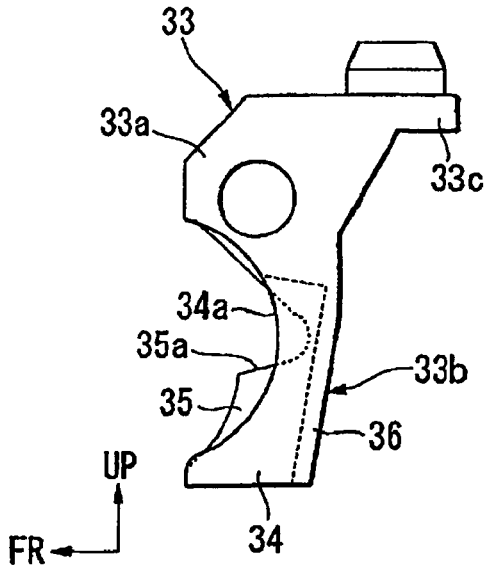
FIG. 6B
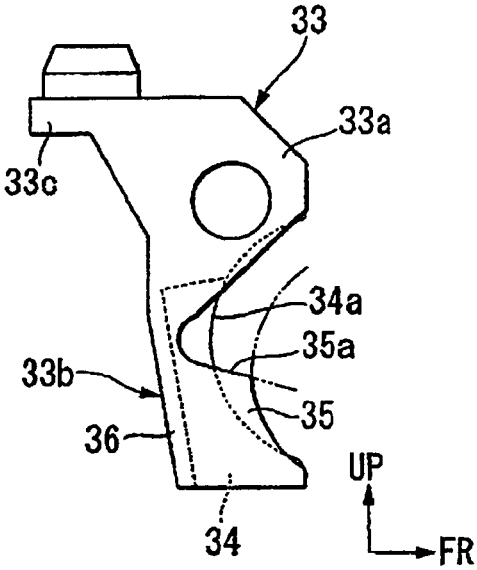
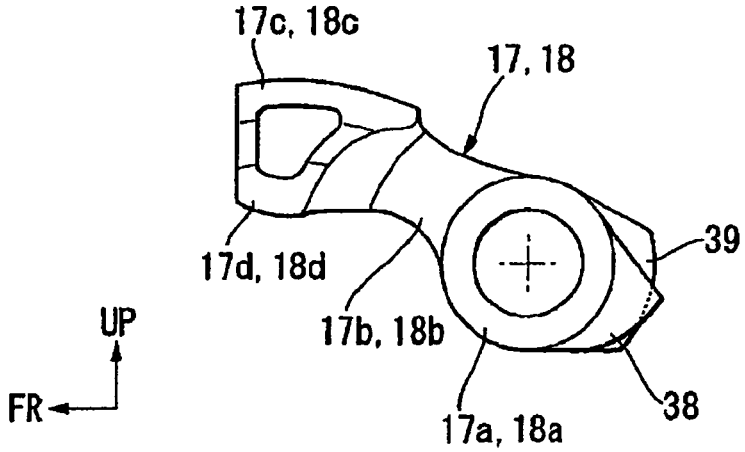
FIG. 7

VALVE ACTUATING MECHANISM FOR AN INTERNAL COMBUSTION ENGINE, AND CYLINDER HEAD INCORPORATING SAME

CROSS REFERENCE TO RELATED APPLICATIONS

This application claims the benefit under 35 USC 119 of Japanese Application No. 2007-095091 filed Mar. 30, 2007, and the entire subject matter of this priority document, including specification, claims and drawings of this document is incorporated by reference.

BACKGROUND OF THE INVENTION

1. Field of the Invention

The present invention relates to a variable valve actuating mechanism of a four-stroke engine preferably applicable to a vehicle such as a motorcycle, wherein the variable valve actuating mechanism includes a camshaft having a pair of cams for alternate selective use in actuating one engine valve, where the mechanism can selectively use either one of the respective cams for performing an opening/closing operation of the engine valve.

2. Description of the Background Art

Conventionally, it has been known to provide a valve actuating mechanism which includes a cam shaft, a rocker arm shaft arranged in parallel with the cam shaft, and a rocker arm supported on the rocker arm shaft such that the rocker arm is pivotally movable about an axis of the rocker arm shaft and is movable in the axial direction of the rocker arm shaft. In response to the rotational driving of the cam shaft, the rocker arm is brought into contact with either one of the respective cams and is rocked to open or close the engine valve and, at the same time, the rocker arm is suitably moved in the axial direction thus allowing the selective use of either one of the respective cams for performing opening/closing operation of the engine valve as disclosed in Japanese patent document JP-A-2001-20710.

In the above-mentioned conventional technique, the rocker arm is moved in the axial direction using engine oil pressure. However, recently, an engine is requested to quickly respond to an operation demand from a driver to the engine.

The above-mentioned conventional arrangement which moves the rocker arm using the engine oil pressure has a drawback that it is difficult to make the moving time of the rocker arm stable (particularly, to enable the quick movement) attributed to a change of state of an engine oil (a change of the viscosity of the engine oil or the like attributed to an oil temperature change or the like). Further, there also exists a drawback that an oil passage for supplying an oil pressure is necessary around a valve chamber and hence, the arrangement of the valve actuating mechanism per se becomes complicated.

BRIEF SUMMARY OF THE INVENTION

Accordingly, it is an object of the present invention to provide a valve actuating mechanism for an engine which can change a cam for opening or closing an engine valve by moving a rocker arm in the axial direction of a rocking shaft, wherein the valve actuating mechanism can move the rocker arm quickly with a relatively simple arrangement.

To overcome the above-mentioned drawbacks, a valve actuating mechanism for an engine which includes a cam shaft which includes a pair of first and second cams for one engine valve and a rocker arm which is supported on a rocker arm shaft which is arranged in parallel with the cam shaft such that the rocker arm is pivotally movable about an axis of the rocker arm shaft and is movable in the axial direction of the rocker arm shaft, wherein the rocker arm is brought into contact with either one of the respective cams in response to the rotational movement of the cam shaft and is rocked to open or close the engine valve, and the rocker arm is moved to either one of a first operation position at which the rocker arm can be brought into contact with the first cam in the axial direction and a second operation position at which the rocker arm can be brought into contact with the second cam in the axial direction thus allowing the valve actuating mechanism to selectively use either one of the respective cams for performing opening/closing operation of the engine valve. The improvement is characterized in that the valve actuating mechanism further includes a first rocker arm moving mechanism having a first spring which imparts a biasing force to the rocker arm for moving the rocker arm from the first operation position side to the second operation position side, and a second rocker arm moving mechanism having a second spring which imparts a biasing force to the rocker arm for moving the rocker arm from the second operation position side to the first operation position side, and after a predetermined force is stored in either one of the respective springs, the rocker arm is configured to be moved to the corresponding operation position using this force.

The valve actuating mechanism includes a rocker arm moving restriction mechanism that restricts the movement of the rocker arm in the axial direction until the predetermined force is stored in either one of the respective springs.

The rocker arm moving restriction mechanism includes a trigger member that is engaged with the rocker arm for restricting the movement of the rocker arm in the axial direction, and a cam member that operates the trigger member so as to remove the engagement of the trigger member with the rocker arm.

The respective springs are coil springs which are wrapped around an outer periphery of the rocker arm shaft, and one ends of the respective springs are engaged with a proximal portion) of the rocker arm through which the rocker arm shaft penetrates.

The rocker arm using the force which is stored in either one of the respective springs, the movement of the rocker arm is not influenced by an oil temperature or the like compared to the case where the engine oil pressure is used for moving the rocker arm and hence, it is possible to stably and quickly move the rocker arm and thus, a valve driving cam can be quickly changed. Further, it becomes unnecessary to provide an oil passage for supplying the oil pressure around the valve chamber and hence, it is possible to simplify the valve actuating mechanism per se. The valve actuating mechanism having such an arrangement is preferably applicable to a motorcycle-use engine that exhibits a relatively high rotational speed and satisfies a demand for the miniaturization and the reduction of weight. Here, the above-mentioned one engine valve may include a plurality of engine valves that corresponds to one cylinder and is operated simultaneously.

There exists no possibility that the rocker arm is moved before either one of the springs stores the predetermined force and hence, it is possible to quickly and accurately move the rocker arm using the force that is stored in either one of the respective springs.

The force is imparted to the proximal portion of the rocker arm through which the rocker arm shaft penetrates from the respective springs and hence, it is possible to smoothly move the rocker arm in the axial direction. Further, it becomes unnecessary to provide engaging portions for the respective springs to an arm portion or the like of the rocker arm additionally and hence, the miniaturization and the reduction of weight of the rocker arm and eventually the valve actuating mechanism per se can be realized.

BRIEF DESCRIPTION OF THE SEVERAL VIEWS OF THE DRAWINGS

FIG. 6(*a*) is a left side view of a trigger arm which is a component of the variable valve adjustment mechanism, and FIG. 6(*b*) is a right side view of the trigger arm.

FIG. 7 is a left side view of left and right rocker arms of the variable valve adjustment mechanism, as viewed in an overlapped manner.

DETAILED DESCRIPTION OF ILLUSTRATIVE EMBODIMENTS

Figure 1:
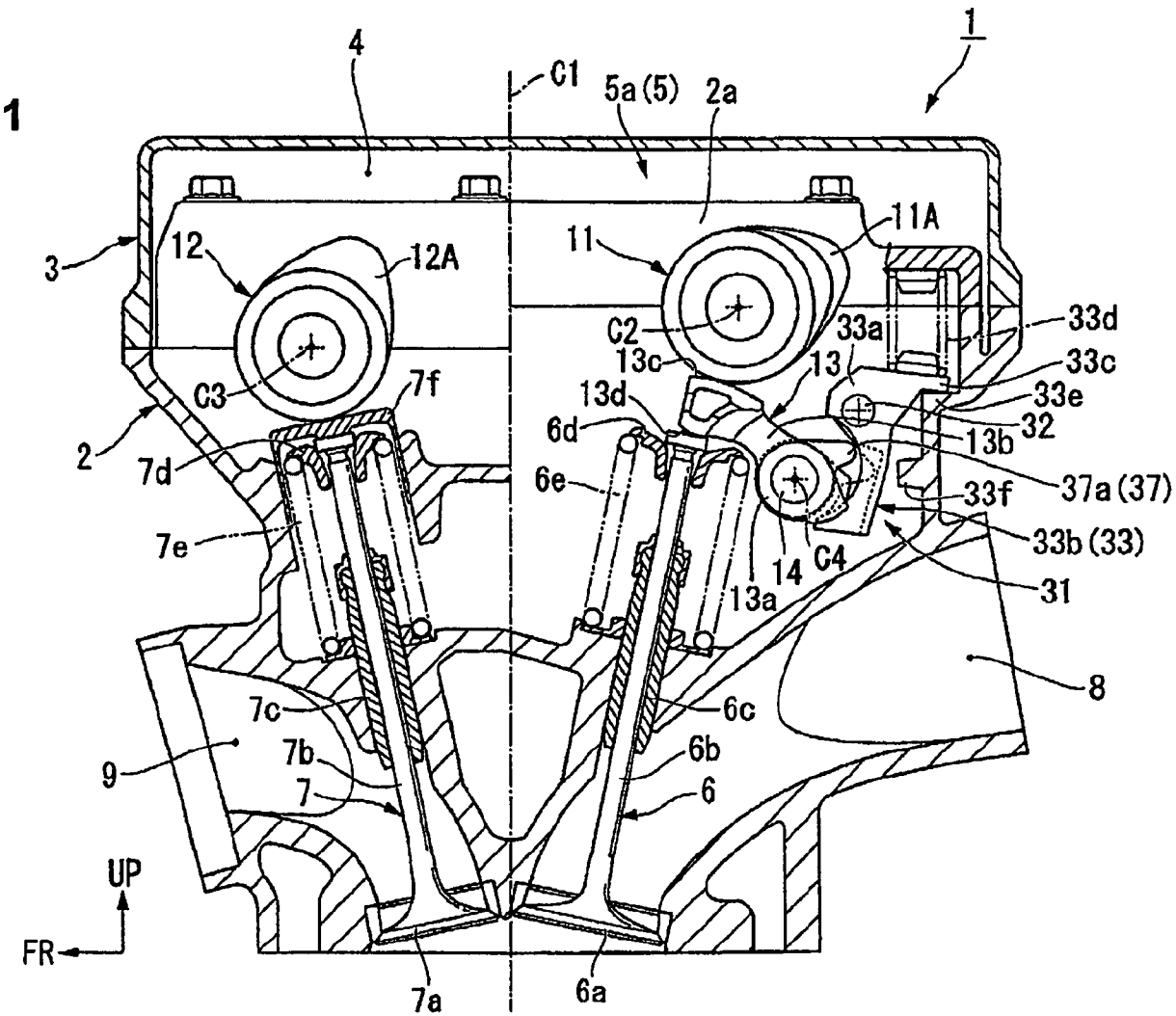
FIG. 1 is a left side view, partially in cross-section, of a cylinder head assembly of an engine according to an illustrative embodiment of the present invention.

Hereinafter, an embodiment of the present invention is explained in conjunction with drawings. Here, in the explanation made hereinafter, an arrow FR indicates the front direction, an arrow LH indicates the leftward direction, and an arrow UP indicates the upward direction in the drawings respectively.

FIG. 1 is a left side view of a cylinder head 2 of a 4-stroke DOHC parallel 4-cylinder engine 1 which is used to a prime mover of a vehicle such as a motorcycle, for example. A head cover 3 is mounted on an upper portion of the cylinder head 2. In the inside of a valve chamber 4 which is formed of the cylinder head 2 and the head cover 3, a valve actuating mechanism 5 for driving intake and exhaust valves 6, 7 is housed. Here, symbol C1 in the drawing indicates a center axis (cylinder axis) of a cylinder bore of a cylinder body.

Intake and exhaust ports 8, 9 are formed in the cylinder head 2 for every cylinder, and combustion-chamber-side openings of the intake and exhaust ports 8, 9 are respectively opened and closed by the intake and exhaust valves 6, 7. The respective intake and exhaust valves 6, 7 are configured such that rod-like stems 6*b*, 7*b* extend from umbrella-shaped valve elements 6*a*, 7*a* which are fitted in the combustion-chamber-side openings toward the valve chamber 4 side, and the stems 6*b*, 7*b* are held by the cylinder head 2 by way of cylindrical valve guides 6*c*, 7*c* in a reciprocating manner.

On distal end portions of the stems 6*b*, 7*b* of the respective valves 6, 7, retainers 6*d*, 7*d* are mounted. The respective valves 6, 7 are biased upwardly due to a spring force of valve springs 6*e*, 7*e* which are arranged between the retainers 6*d*, 7*d* and the cylinder head 2 in a compressible manner, and the valve elements 6*a*, 7*a* close the combustion chamber-side openings. On the other hand, by allowing the respective valves 6, 7 to perform a stroke downwardly against the biasing force of the valve springs 6*e*, 7*e*, the valve elements 6*a*, 7*a* of the respective valves 6, 7 are moved away from the combustion chamber-side openings to open the combustion chamber-side openings.

The stems 6*b*, 7*b* of the respective valves 6, 7 are arranged such that the stems 6*b*, 7*b* are inclined with respect to a cylinder axis C1 in a V-shaped manner as viewed in a side view. An intake-side camshaft 11 and an exhaust-side camshaft 12 which extend along the lateral direction are respectively arranged above the respective stems 6*b*, 7*b*. The respective camshafts 11, 12 are supported on the cylinder head 2 (including a shaft holder 2*a*) in a rotatable manner about axes thereof. When the engine 1 is driven, for example, the camshafts 11, 12 are rotationally driven in an interlocking manner with a crankshaft by way of a chain-type power transmission mechanism (both the power transmission mechanism and the crankshaft not shown in the drawing). Here, in the drawing, symbols C2, C3 indicate center axes (cam axes) of the respective camshafts 11, 12.

Here, the engine 1 is of a 4-valve type and includes the pair of left and right intake and exhaust valves 6, 7 for every cylinder thereof.

The respective intake valves 6 are opened and closed by being pushed by a cam 11A of the intake-side camshaft 11 by way of a rocker arm 13 provided for every cylinder. On the other hand, the respective exhaust valves 7 are opened and closed by being directly pushed by a cam 12A of the exhaust-side camshaft 12 by way of a valve lifter 7*f* that is mounted on a distal end portion of the stem 7*b*. The rocker arm 13 is supported on a rocker arm shaft 14 that is arranged in parallel to the intake-side camshaft 11 behind a distal end portion of the stem 6*b* of the intake valve 6 in a pivotally movable manner about an axis of the rocker arm shaft 14. Here, symbol C4 in the drawing indicates a center axis (rocker axis) of the rocker arm shaft 14.

An arm portion 13*b* extends to a distal end portion of the stem 6*b* of the intake valve 6 from a cylindrical proximal portion 13*a* that penetrates the rocker arm shaft 14 of the rocker arm 13. A cam slide-contact portion 13*c* with which the cam 11A of the intake-side cam shaft 11 is in a slidable contact is mounted on an upper portion of the distal end portion of the arm portion 13*b* and, at the same time, a valve pushing portion 13*d* which can push the distal end portion of the stem 6*b* downwardly is mounted on a lower portion of the distal end portion of the arm portion 13*b*.

Further, when the intake-side camshaft 11 is rotatably driven at the time of driving the engine 1, the cam 11A of the camshaft 11 is brought into slide contact with the cam slide-contact portion 13*c* thus suitably rocking the rocker arm 13. Accordingly, the valve pushing portion 13*d* of the rocker arm 13 pushes the distal end portion of the stem 6*b* of the intake valve 6 so that the intake valve 6 is suitably reciprocated along the stem 6*b* to open or close the combustion-chamber-side opening. Here, the rocker arm 13 may include a cam roller that is brought into rolling contact with the cam 11A of the intake-side camshaft 11.

Here, on an intake side of the valve actuating mechanism 5 of the engine 1, a valve variable mechanism 5*a* which changes valve opening/closing timings and lift quantities of the respective intake valves 6 is arranged. The valve variable mechanism 5*a* opens and closes the respective intake valves 6 using a low-speed rotation cam of the intake-side cam shaft 11 in a low-speed rotation range in which an engine rotational speed is less than 6000 rpm (revolution per minute), for example. On the other hand, the valve variable mechanism 5*a* opens and closes the respective intake valves 6 using a high-speed rotation cam of the intake-side cam shaft 11 in a high-speed rotation range in which the engine rotational speed is 6000 rpm or more.

Hereinafter, the valve variable mechanism 5*a* corresponding to one cylinder is explained. In the explanation made hereinafter, however, assuming that other cylinders also have the substantially same valve variable mechanism as one cylinder, the repeated explanation is omitted.

Figure 2:
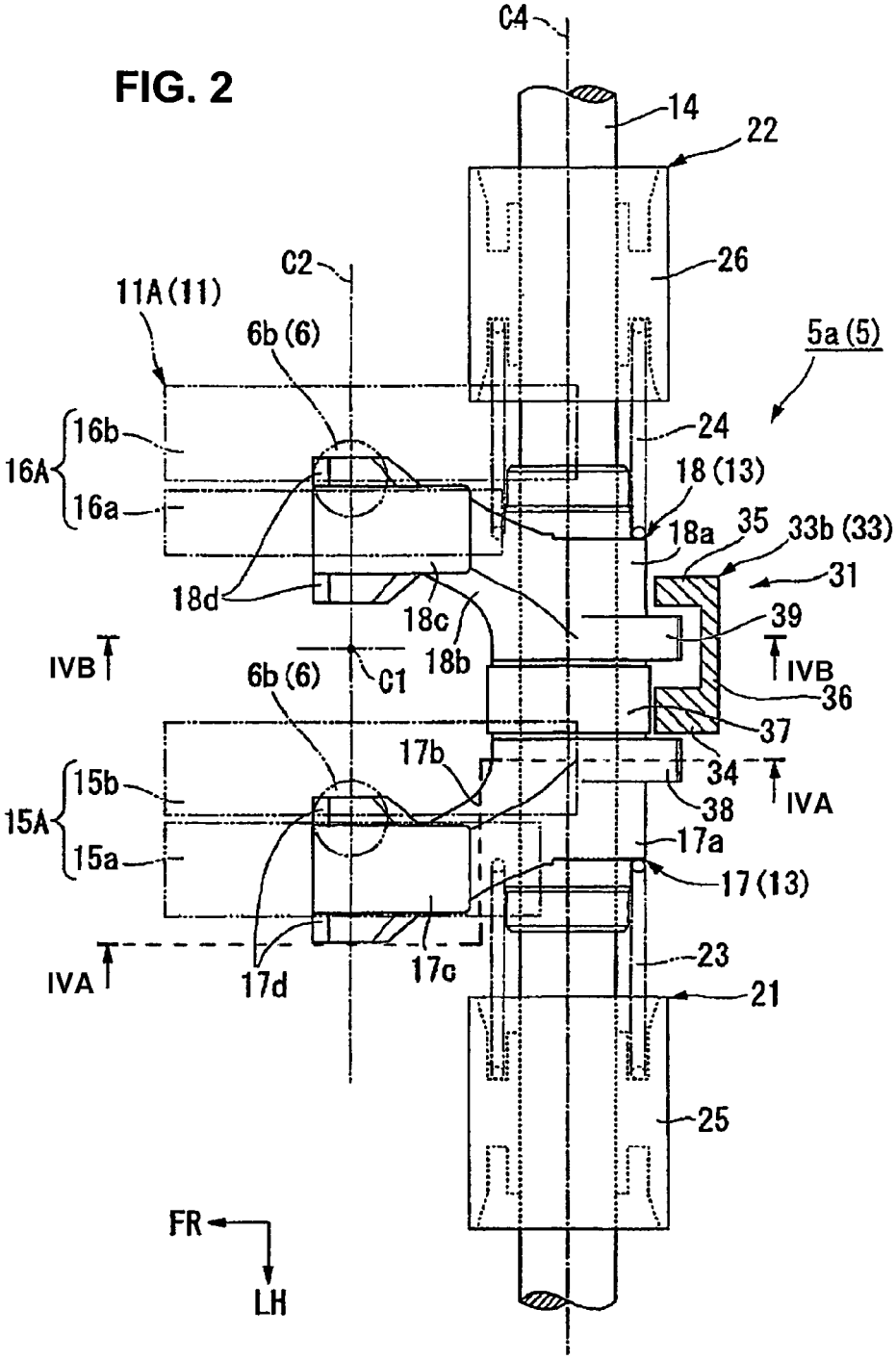
FIG. 2 is a top plan detail view of an essential part of a variable valve adjustment mechanism of the engine at a time of low-speed operation thereof.

To explain the above-mentioned arrangement also in conjunction with FIG. 2, the cam 11A of the intake-side cam shaft 11 consists of the left and right first cams 15*a*, 16*a* for low-speed rotation range and the left and right second cams 15*b*, 16*b* for high-speed rotation range which correspond to the left and right intake valves 6. That is, the intake-side cam shaft 11 includes four cams in total consisting of the left and right first cams 15*a*, 16*a* and the left and right second cams 15*b*, 16*b* which respectively correspond to the left and right intake valves 6 for one cylinder.

Hereinafter, a pair of the first cams 15*a*, 16*a* and a pair of second cams 15*b*, 16*b* which respectively correspond to the left and right intake valves 6 are referred to as left and right cam pairs 15A, 16A. The left and right cam pairs 15A, 16A are arranged in an allocated manner at positions in substantially left-and-right symmetry with respect to the cylinder axis C1 sandwiched between the pairs. The left and right cam pairs 15A, 16A are spaced apart from each other with a predetermined distance therebetween in the cam axis direction. Further, the left and right cam pairs 15A, 16A respectively arrange the first cams 15*a*, 16*a* and the second cams 15*b*, 16*b* close to each other in the cam axis direction such that the first cams 15*a*, 16*a* are arranged on a left side and the second cams 15*b*, 16*b* are arranged on a right side.

Further, the rocker arm 13 is supported on the rocker arm shaft 14 such that the rocker arm 13 is pivotally movable about an axis (about a rocker axis C4) of the rocker arm shaft 14 and is movable in the axial direction (in the direction along the rocker axis C4) of the rocker arm shaft 14. Further, the rocker arm 13 is divided into left and right rocker arms 17, 18 that are movable relative to each other (pivotally movable relative to each other about the axis and movable relative to each other in the axial direction). The left and right rocker arms 17, 18 are respectively provided corresponding to the left and right intake valves 6, and the left and right rocker arms 17, 18 are individually rocked by the left and right first cams 15*a*, 16*a* or the second cams 15*b*, 16*b* thus opening and closing the left and right intake valves 6.

Hereinafter, proximal portions of the left and right rocker arms 17, 18 are respectively indicated by numerals 17*a*, 18*a*, arm portions of the left and right rocker arms 17, 18 are respectively indicated by numerals 17*b*, 18*b*, cam slide-contact portions of the left and right rocker arms 17, 18 are respectively indicated by numerals 17*c*, 18*c*, and valve pushing portions of the left and right rocker arms 17, 18 are respectively indicated by numerals 17*d*, 18*d*. Here, the left and right arm portions 17*b*, 18*b*, the cam slide-contact portions 17*c*, 18*c*, and the valve pushing portions 17*d*, 18*d* are respectively provided in an offset manner relative to the left and right proximal portions 17*a*, 18*a* in the laterally outward direction of the cylinder.

Figure 4B:
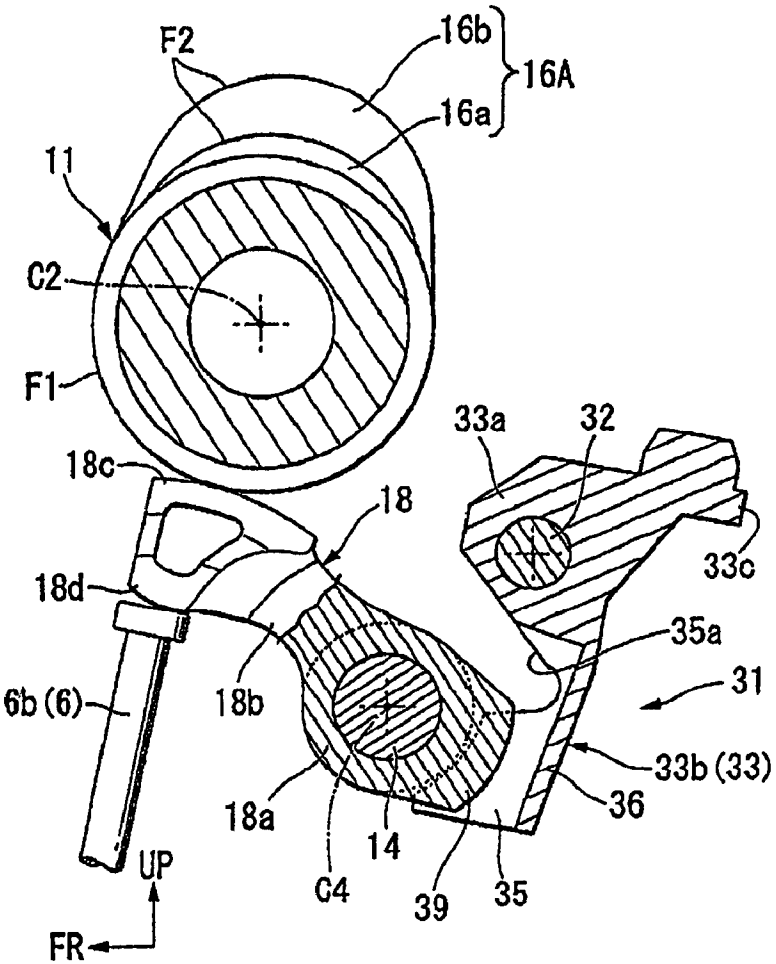
FIG. 4(*a*) is a cross-sectional view taken along the line IVA-IVA in FIG. 2, and FIG. 4(*b*) is a cross-sectional view taken along the line IVB-IVB in FIG. 2.
Figure 4A:
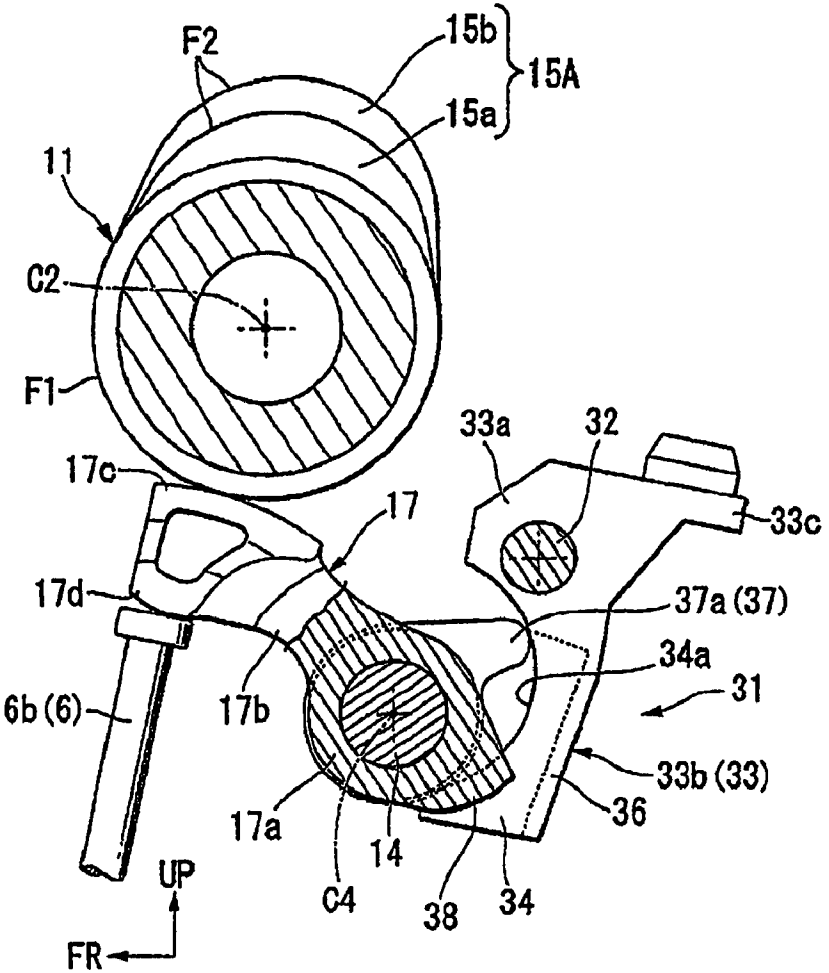

To explain the above-mentioned arrangement also in conjunction with FIG. 4, the first cams 15*a*, 16*a* and the second cams 15*b*, 16*b* form cylindrical zero-lift surfaces F1 which use the cam axis C2 as the center thereof and have the same diameter, and mountain-shaped lift surfaces F2 which project toward an outer peripheral side from the zero-lift surfaces F1 at predetermined rotational positions. When the zero-lift surfaces F1 of the respective cams 15*a*, 16*a*, 15*b*, 16*b* face the cam slide-contact portions 17*c*, 18*c* of the left and right rocker arms 17, 18 in an opposed manner, the intake valves 6 assume a valve closed state in which the intake valves 6 are completely closed (a lift quantity assuming 0), while when the lift surfaces F2 are brought into slide contact with the cam slide-contact portions 17*c*, 18*c*, the intake valves 6 assume a valve open state in which the intake valves 6 are opened with a predetermined quantity (the intake valves 6 being lifted predetermined amount).

Projection quantities (lift quantities) of the lift surfaces F2 of the first cams 15*a*, 16*a* of the left and right cam pairs 15A, 16A are set smaller than projection quantities (lift quantities) of the lift surfaces F2 of the second cams 15*b*, 16*b*. Further, projection quantities and shapes of the lift surfaces F2 of the second cams 15*b*, 16*b* of the left and right cam pairs 15A, 16A are set equal to each other. On the other hand, the projection quantity of the lift surface F2 of the first cam 16*a* of the right cam pair 16A is set smaller than the projection quantity of the lift surface F2 of the first cam 15*a* of the left cam pair 15A, for example. Accordingly, an intake-air speed in the low-speed rotation range of the engine 1 is increased and, at the same time, the difference in intake-air quantity at the time of changing over the cams is increased and hence, it is possible to emphasize the change of the intake-air characteristic. Here, the lift quantity of the first cam 16*a* of the right cam pair 16A may be set to 0, or the projection quantities of the lift surfaces F2 of the first cams 15*a*, 16*a* may be set equal to each other.

The left and right rocker arms 17, 18 are respectively biased inwardly in the lateral direction of the cylinder due to first and second rocker arm moving mechanisms 21, 22 described later, and are integrally movably supported on the rocker arm shaft 14 in the axial direction of the rocker arm shaft 14 such that proximal portions 17*a*, 18*a* of the left and right rocker arms 17, 18 abut each other in the axial direction of the rocker arm shaft 14 by way of a center collar 37 described later.

When the operation of the engine 1 is stopped or when the engine 1 is operated in a low-speed rotation range, the left and right rocker arms 17, 18 assume leftward-movement limit positions in the axial direction. In such a state, the cam slide-contact portions 17*c*, 18*c* of the left and right rocker arms 17, 18 are arranged at positions below the first cams 15*a*, 16*a* of the respective left and right cam pairs 15A, 16A where the slide-contact portions 17*c*, 18*c* can be brought into slide contact with outer peripheral surfaces (cam surfaces) of the first cams 15*a*, 16*a*.

The valve pushing portions 17*d*, 18*d* of the left and right rocker arms 17, 18 are formed with lateral widths thereof set larger than lateral widths of the cam slide-contact portions 17*c*, 18*c*. When the left and right rocker arms 17, 18 assume the above-mentioned leftward-movement limit positions, right end portions of the left and right rocker arms 17, 18 are arranged at positions where the right end portions thereof can push the distal end portions of the stems 6*b* of the left and right intake valves 6. Here, the positions of the left and right rocker arms 17, 18 in the axial direction are referred to as first operation positions.

Figure 3:
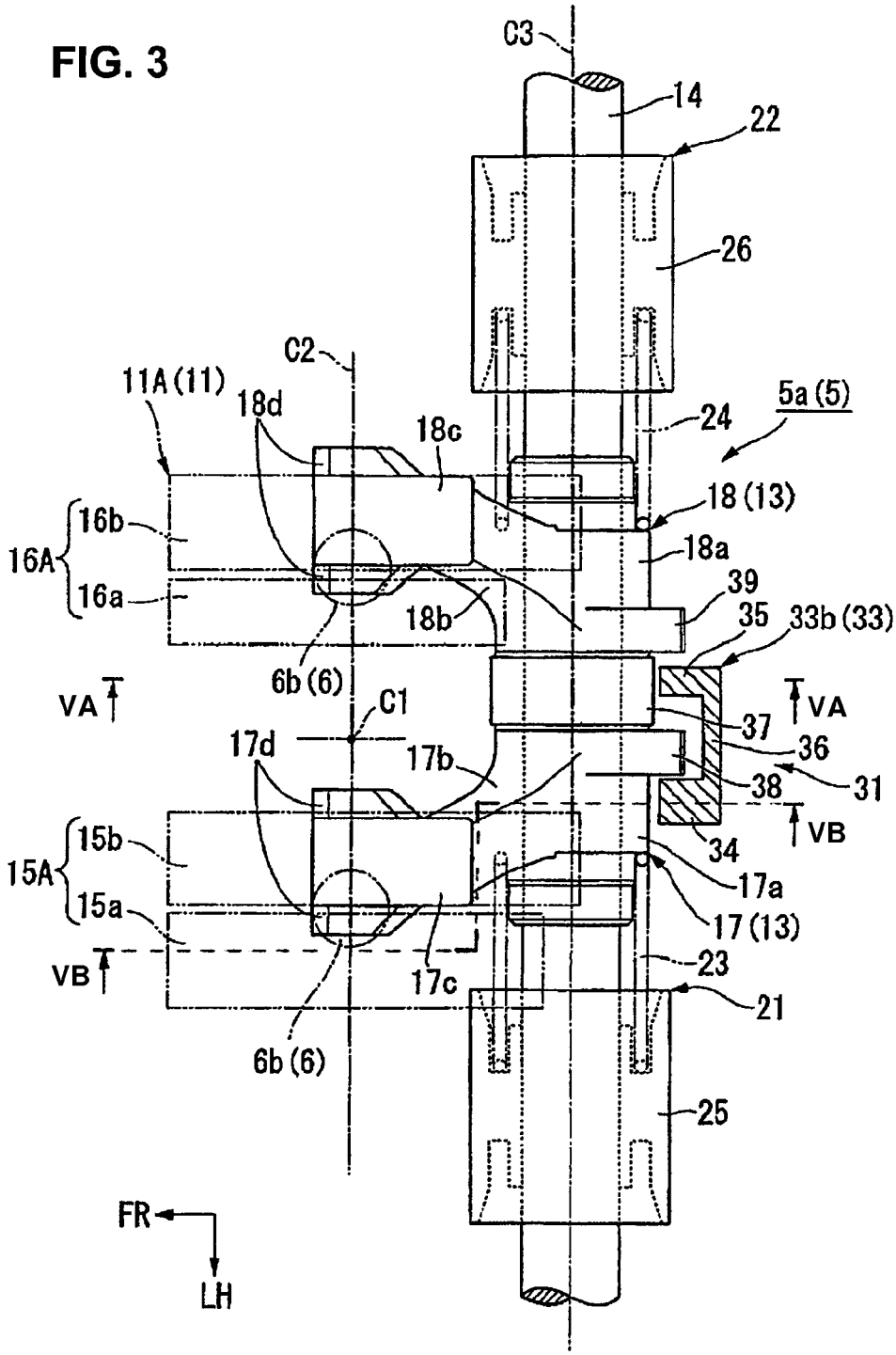
FIG. 3 is a top plan detail view of the essential part of the variable valve adjustment mechanism at a time of high-speed operation thereof.

On the other hand, to explain the above-mentioned arrangement also in conjunction with FIG. 3, the left and right rocker arms 17, 18 assume the rightward-movement limit positions in the axial direction when the engine 1 is operated in a high-speed rotation range. In such a state, the cam slide-contact portions 17*c*, 18*c* of the left and right rocker arms 17, 18 are respectively arranged at positions below the second cams 15*b*, 16*b* of the left and right cam pairs 15A, 16A where the cam slide-contact portions 17*c*, 18*c* can be brought into slide contact with the outer peripheral surfaces (cam surfaces) of the second cams 15*b*, 16*b*.

When the left and right rocker arms 17, 18 assume the above-mentioned rightward-movement limit positions, left end portions of the valve pushing portions 17*d*, 18*d* of the left and right rocker arms 17, 18 are arranged at positions where the left end portions can push the distal end portions of the stems 6*b* of the left and right intake valves 6. Here, positions of the left and right rocker arms 17, 18 in the axial direction are referred to as second operation positions.

That is, the valve variable mechanism 5*a* operates the first and second rocker arm moving mechanisms 21, 22 in response to the engine rotational speed so as to move the left and right rocker arms 17, 18 to either one of the first operation position or the second operation position in the axial direction of the rocker arm shaft 14. Accordingly, the valve variable mechanism 5*a* allows the selective use of any one of the respective cams 15*a*, 16*a*, 15*b*, and 16*b* in the opening/closing operation of the left and right intake valves 6.

The first rocker arm moving mechanism 21 includes a first spring 23 which is positioned on a left side of the proximal portion 17*a* of the left rocker arm 17 and applies a biasing force directed to the second operation position side (high-speed rotation side) from the first operation position side (low-speed rotation side) to the proximal portion 17*a*, and a first spring-receiving collar 25 which is positioned on a left side of the first spring 23 and is supported on an outer periphery of the rocker arm shaft 14 such that the first spring-receiving collar 25 is not movable in the axial direction relative to the rocker arm shaft 14.

In the same manner, the second rocker arm moving mechanism 22 includes a second spring 24 which is positioned on a right side of the proximal portion 18*a* of the right rocker arm 18 and applies a biasing force directed to the first operation position side from the second operation position side to the proximal portion 18*a*, and a second spring-receiving collar 26 which is positioned on a right side of the second spring 24 and is supported on the outer periphery of the rocker arm shaft 14 such that the second spring-receiving collar 26 is not movable in the axial direction relative to the rocker arm shaft 14.

The respective springs 23, 24 are formed of a compression coil spring, which is arranged to wrap around the outer periphery of the rocker arm shaft 14 (to allow the rocker arm shaft 14 to penetrate the springs 23, 24). A right end portion of the first spring 23 is fitted in a left-side outer periphery of the proximal portion 17*a* of the left rocker arm 17, and a left end portion of the first spring 23 is fitted in a right-side inner periphery of the first spring-receiving collar 25. On the other hand, a left end portion of the second spring 24 is fitted in a right-side outer periphery of the proximal portion 18*a* of the right rocker arm 18, and a right end portion of the second spring 24 is fitted in a left-side inner periphery of the second spring-receiving collar 26.

Here, the rocker arm shaft 14 is supported on the cylinder head 2 such that the rocker arm shaft 14 is movable in the axial direction thereof and is rotatable about an axis thereof.

When the operation of the engine 1 is stopped or when the engine 1 is operated in a low-speed rotation range, the rocker arm shaft 14 and the respective spring-receiving collars 25, 26 assume the leftward-movement limit position in the axial direction thereof (see FIG. 2). Here, the left and right rocker arms 17, 18 assume the first operation position, and the respective springs 23, 24 are arranged between the proximal portions 17*a*, 18*a* of the left and right rocker arms 17, 18 and the respective spring-receiving collars 25, 26 in a compressible manner such that a predetermined initial compression is applied to the springs 23, 24. Here, initial loads which the respective springs 23, 24 possess are set equal to each other and hence, the left and right rocker arms 17, 18 can be held at the first operation position.

On the other hand, to explain the above-mentioned arrangement in conjunction with FIG. 3, when the engine 1 is operated in a high-speed rotation range, the rocker arm shaft 14 and the respective spring-receiving collars 25, 26 assume the rightward-movement limit position in the axial direction thereof. Here, the left and right rocker arms 17, 18 assume the second operation position, and the respective springs 23, 24 are arranged between the proximal portions 17*a*, 18*a* of the left and right rocker arms 17, 18 and the respective spring-receiving collars 25, 26 in a shrinkable manner such that an initial compression is applied to the springs 23, 24 in the substantially same manner as described above. Here, initial loads which the respective springs 23, 24 possess are set equal to each other and hence, the left and right rocker arms 17, 18 can be held at the second operation position.

Here, the movement quantities of the rocker arm shaft 14 and the respective spring-receiving collars 25, 26 in the axial direction are equal to the movement quantities of the left and right rocker arms 17, 18 in the axial direction (a movement quantity between the respective operation positions).

Further, such that the movements of the left and right rocker arms 17, 18 in the axial direction with respect to the cylinder head 2 are restricted by a rocker arm movement restricting mechanism 31 described later, by integrally moving the rocker arm shaft 14 and the respective spring-receiving collars 25, 26 in the axial direction with respect to the cylinder head 2, a predetermined difference in resilient force is generated between the respective springs 23, 24.

To be more specific, when the rocker arm shaft 14 and the respective spring-receiving collars 25, 26 are moved from the leftward-movement limit position to the rightward-movement limit position with respect to the cylinder head 2, the first spring 23 is compressed by a quantity corresponding to the movement of the rocker arm shaft 14 and the respective spring-receiving collars 25, 26 thus increasing the resilient force of the first spring 23 and, at the same time, the second spring 24 is expanded by the quantity corresponding to the movement of the rocker arm shaft 14 and the respective spring-receiving collars 25, 26 thus decreasing the resilient force of the second spring 24. On the other hand, when the rocker arm shaft 14 and the respective spring-receiving collars 25, 26 are moved from the rightward-movement limit position to the leftward-movement limit position with respect to the cylinder head 2, the second spring 24 is compressed by a quantity corresponding to the movement of the rocker arm shaft 14 and the respective spring-receiving collars 25, 26 thus increasing the resilient force of the second spring 24 and, at the same time, the first spring 23 is expanded by a quantity corresponding to the movement of the rocker arm shaft 14 and the respective spring-receiving collars 25, 26 thus decreasing the resilient force of the first spring 23.

In this manner, by making use of the difference in resilient force between the respective springs (hereinafter, referred to as the resilient force stored in either one of the respective springs 23, 24), the left and right rocker arms 17, 18 are moved to the second or first operation position from the first or second operation position. Here, as the expanding quantities of the respective springs 23, 24, the initial compression quantities of the respective springs 23, 24 are used.

The rocker arm movement restricting mechanism 31 is provided for restricting the movements of the left and right rocker arms 17, 18 in the axial direction until the predetermined resilient force is stored in either one of the respective springs 23, 24. The rocker arm movement restricting mechanism 31 includes a trigger arm 33 which is supported on the cylinder head 2 by way of a support shaft 32 arranged in parallel to the rocker arm shaft 14 such that the trigger arm 33 is pivotally movable about an axis of the support shaft 32 and is not movable in the axial direction of the support shaft 32, and the center collar 37 which is supported on the rocker arm shaft 14 between the proximal portions 17*a*, 18*a* of the left and right rocker arms 17, 18 such that the center collar 37 is not relatively rotatable about the axis of the rocker arm shaft 14 and is relatively movable in the axial direction of the rocker arm shaft 14.

The trigger arm 33 is arranged behind the rocker arm shaft 14, and the trigger arm 33 is arranged in left and right symmetry with respect to the cylinder axis C1, for example. The support shaft 32 of the trigger arm 33 is arranged at an oblique rear upper position with respect to the rocker arm shaft 14, and an arm portion 33*b* having a U-shape in cross section which includes left and right wall portions 34, 35 and a rear wall portion 36 extends downwardly from a proximal portion 33*a* of the trigger arm 33 which penetrates the support shaft 32.

To explain the above-mentioned arrangement also in conjunction with FIG. 6, left and right notched portions 34*a*, 35*a* which open toward a front side while having shapes different from each other as viewed in a side view are formed in the left and right wall portions 34, 35 of the arm portion 33*b* of the trigger arm 33. To be more specific, the left notched portion 34*a* is formed in a semicircular shape that spans between a lower side of the proximal portion 33*a* and a distal end side of the arm portion 33*b* as viewed in a side view. On the other hand, the right notched portion 35*a* is configured such that the right notched portion 35*a* has a lower portion thereof formed in a semicircular shape having a diameter smaller than the left notched portion 34*a* as viewed in a side view and an upper portion thereof formed in a mountain shape which projects rearward from the left notched portion 34*a* as viewed in a side view, and the lower portion and the upper portion of the right notched portion 35*a* overlap each other by a predetermined quantity in the vertical direction. Hereinafter, the left and right wall portions 34, 35 of the trigger arm 33 are respectively referred to as left and right trigger-side key portions 34, 35.

On a rear side of the proximal portion 33*a* of the trigger arm 33, a substantially-horizontal-plate-shaped stopper portion 33*c* that extends rearward is formed. To explain the above-mentioned arrangement in conjunction with FIG. 1, the stopper portion 33*c* receives a resilient force of a spring (compression coil spring) 33*d* which is arranged between the cylinder head 2 and the stopper 33*c* in a compressible manner from above and, at the same time, brings a lower surface thereof into contact with an upper surface of a stopper receiving portion 33*e* of the cylinder head 2 and hence, the rotation (rocking) of the trigger arm 33 in the clockwise direction (CW) in FIG. 1, FIG. 4 and other drawings is restricted.

Here, the trigger arm 33 is biased in the clockwise direction in FIG. 1, FIG. 4 and other drawings due to the spring 33*d*, and the trigger arm 33 is held such that the arm portion 33*b* is arranged close to the rocker arm shaft 14 from behind the rocker arm shaft 14. This state of the trigger arm 33 is referred to as a pre-rocking state of the trigger arm 33.

On a portion of an inner wall surface of the cylinder head 2 which is arranged behind the arm portion 33*b*, a rocking restriction portion 33*e* which can be brought into contact with a rear surface of the trigger arm 33 when the trigger arm 33 is rotated in the counter clockwise direction (CCW) in FIG. 1, FIG. 4 and other drawings is formed. Due to such an arrangement, a rocking angle of the trigger arm 33 when the trigger arm 33 is rocked against the biasing force of the spring 33*d* can be restricted. Here, the rocking restriction portion may be formed on a rear surface of the trigger arm 33.

As shown in FIG. 2, FIG. 4 and FIG. 7, on rear sides of the proximal portions 17*a*, 18*a* of the left and right rocker arms 17, 18, left and right rocker-side key portions 38, 39 which project rearward while having shapes different from each other as viewed in a side view are formed. To be more specific, the left rocker-side key portion 38 is formed on a rear side of the right end portion of the left proximal portion 17*a* in a mountain shape as viewed in a side view. Further, the left rocker-side key portion 38 is formed in a wall-shape orthogonal to the lateral direction, and a lower portion of the left rocker-side key portion 38 is formed into an arcuate shape that is brought into contact with a tangential line extending toward a lower end of the proximal portion 17*a* as viewed in a side view. On the other hand, the right rocker-side key portion 39 is formed on a rear side of a left end portion of the right proximal portion 18*a* in a substantially trapezoidal shape as viewed in a side view. Further, the right rocker-side key portion 39 is formed in a wall-shape orthogonal to the lateral direction, and a rear portion of the right rocker-side key portion 39 is formed into an arcuate shape substantially coaxial with the rocker arm shaft 14 as viewed in a side view.

When the left and right rocker arms 17, 18 are arranged at the first operation position, the left-rocker-side key portion 38 is arranged adjacent to a left side of the left trigger-side key portion 34 of the trigger arm 33 (see FIG. 2), while when the left and right rocker arms 17, 18 are arranged at the second operation position, the left rocker-side key portion 38 is arranged adjacent to a right side of the left trigger-side key portion 34 (see FIG. 3). When the trigger arm 33 is in the pre-rocking state, the left trigger-side key portion 34 of the trigger arm 33 overlaps the left rocker-side key portion 38 by a predetermined quantity as viewed in the axial direction.

On the other hand, when the left and right rocker arms 17, 18 are arranged at the first operation position, the right rocker-side key portion 39 is arranged adjacent to a left side of the right trigger-side key portion 35 of the trigger arm 33 (see FIG. 2), while when the left and right rocker arms 17, 18 are arranged at the second operation position, the right rocker-side key portion 39 is arranged adjacent to a right side of the right trigger-side key portion 35 (see FIG. 3). When the trigger arm 33 is in the pre-rocking state, the right trigger-side key portion 35 of the trigger arm 33 overlaps the right rocker-side key portion 39 by a predetermined quantity as viewed in the axial direction.

Between the left and right rocker-side key portions 38, 39 and the left and right trigger-side key portions 34, 35 which are respectively arranged adjacent to each other, a predetermined clearance is defined in the axial direction such that the forces from the respective rocker arm moving mechanisms 21, 22 are not applied to the left and right rocker arms 17, 18 (a state that a predetermined initial compression is applied to the respective springs 23, 24, in other words, a state that the forces which are applied to the left and right rocker arms 17, 18 from the respective springs 23, 24 are equal to each other) (see FIG. 2, FIG. 3).

Figure 8A:
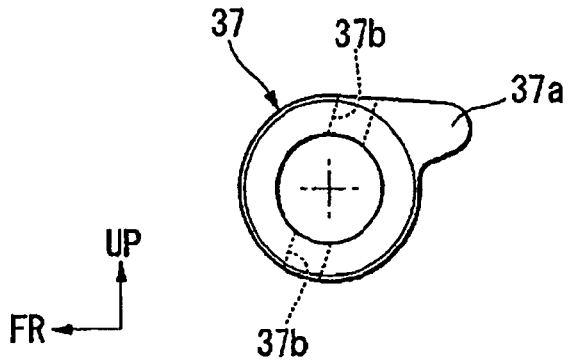
FIG. 8(*a*) is a left side view of a center collar of the variable valve adjustment mechanism, and FIG. 8(*b*) is an exploded perspective view showing the center collar being assembled to the rocker arm shaft.
Figure 8B:
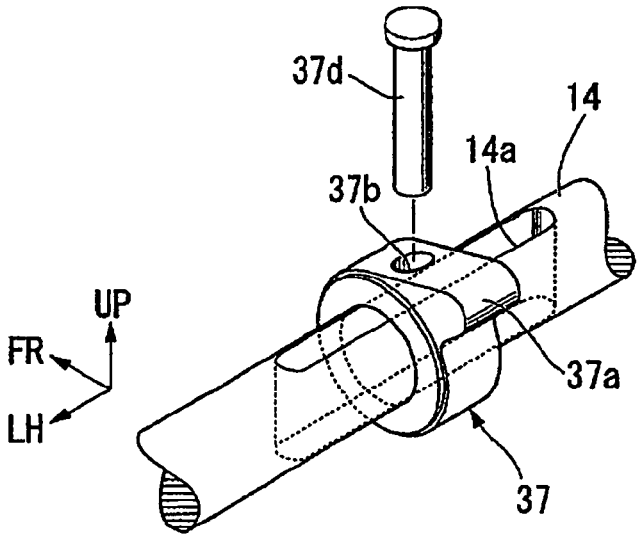

As shown in FIGS. 8A-8B, the center collar 37 is formed substantially in a ring shape, having a diameter substantially equal to diameters of the proximal portions 17*a*, 18*a* of the left and right rocker arms 17, 18. The center collar 37 has a central bore 37*c* formed axially therethrough to slidably receive the rocker arm shaft 14 therein. The center collar 37 also includes a center cam portion 37*a*, formed on a rear outer side of an upper portion of the center collar 37. The center cam portion 37*a* extends rearwardly along a substantially horizontal tangential line. The center collar 37 also has a radial through hole 37*b* formed therein, which extends radially outwardly from the central bore 37*c* through the center collar 37 in opposite directions, as shown in FIG. 8A.

In addition, a central slot 14*a* is formed in the rocker arm shaft 14 at a predetermined position, and this central slot 14*a* extends through the rocker arm shaft 14 in the radial direction while extending a predetermined length in the axial direction, as shown.

The center collar 37 is mounted on the rocker arm shaft 14 at the predetermined position, and these parts are assembled to each other by way of an engaging pin 37*d* which penetrates the through hole 37*b* and the central slot 14*a* and hence, the center collar 37 is supported on the rocker arm shaft 14 at the predetermined position such that the center collar 37 is not relatively rotatable about the axis of the rocker arm shaft 14 and is relatively movable in the axial direction of the rocker arm shaft 14 by a quantity corresponding to a length of the central slot 14*a*.

Figure 5B:
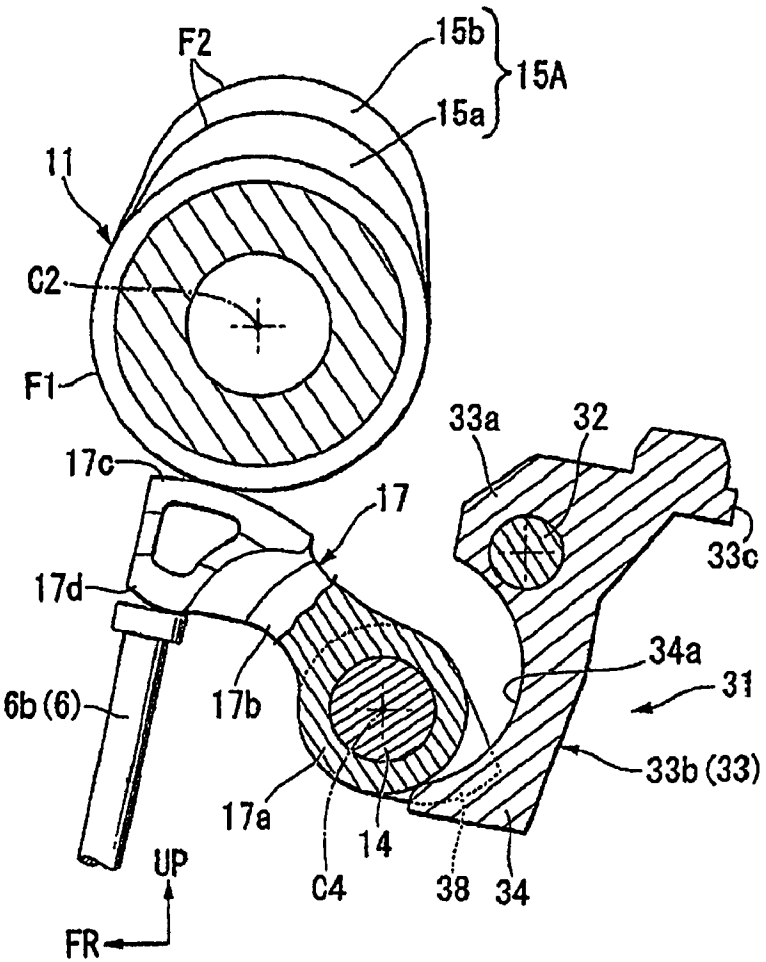
FIG. 5(*a*) is a cross-sectional view taken along the line VA-VA in FIG. 3, and FIG. 5(*b*) is a cross-sectional view taken along the line VB-VB in FIG. 3.
Figure 5A:
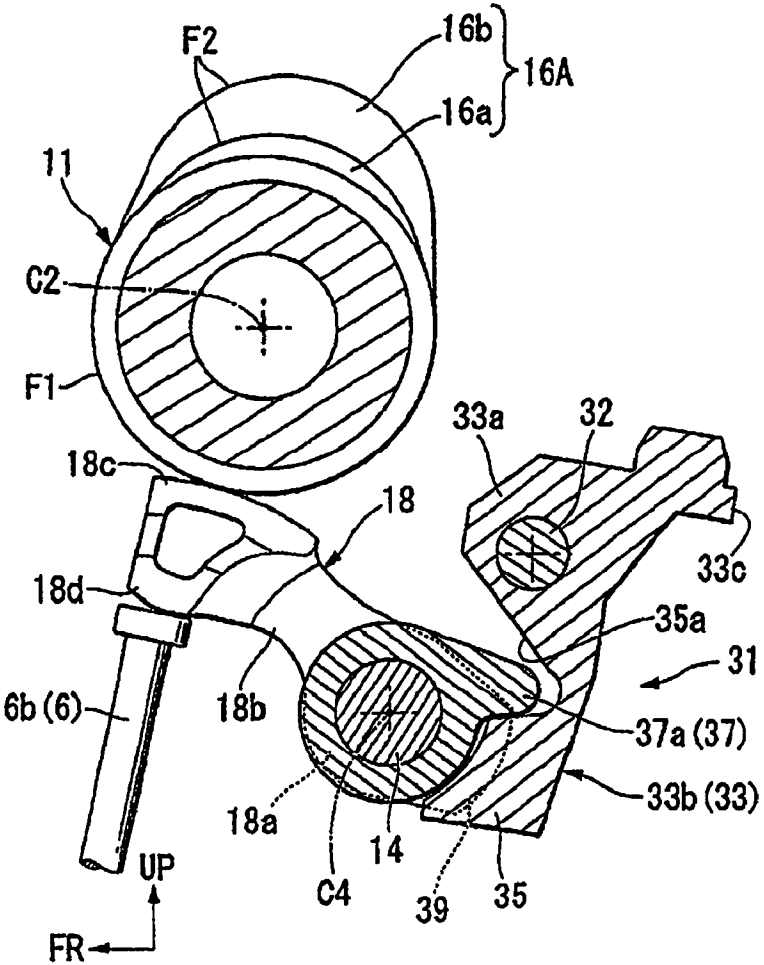

To explain the above-mentioned arrangement in conjunction with FIG. 2 and FIG. 4(*a*), when the left and right rocker arms 17, 18 are arranged at the first operation position, the center cam portion 37*a* is arranged in the inside of the notched portion 34*a* of the left trigger-side key portion 34 of the trigger arm 33, and a distal end portion of the center cam portion 37*a* is arranged close to an upper inner peripheral surface of the left notched portion 34*a*. On the other hand, to explain the above-mentioned arrangement in conjunction with FIG. 3 and FIG. 5, when the left and right rocker arms 17, 18 are arranged at the second operation position, the center cam portion 37*a* is arranged in the inside of the notched portion 35*a* of the right trigger-side key portion 35 of the trigger arm 33, and a distal end portion of the center cam portion 37*a* is arranged close to an upper inner peripheral surface of the right notched portion 35*a*.

Here, the rocker arm shaft 14 is moved in the axial direction thereof with respect to the cylinder head 2 due to an operation of a shaft driving mechanism 41 described later and, at the same time, is rotatable about the axis thereof along with the axial movement thereof. To be more specific, when the rocker arm shaft 14 is arranged at the leftward-movement limit position, the rocker arm shaft 14 is arranged at a counterclockwise rotation limit position about an axis thereof in FIG. 4 and other drawings, and when the rocker arm shaft 14 is arranged at the rightward-movement limit position, the rocker arm shaft 14 is arranged at a clockwise rotation limit position about the axis thereof in FIG. 4 and other drawings.

Figure 10B:
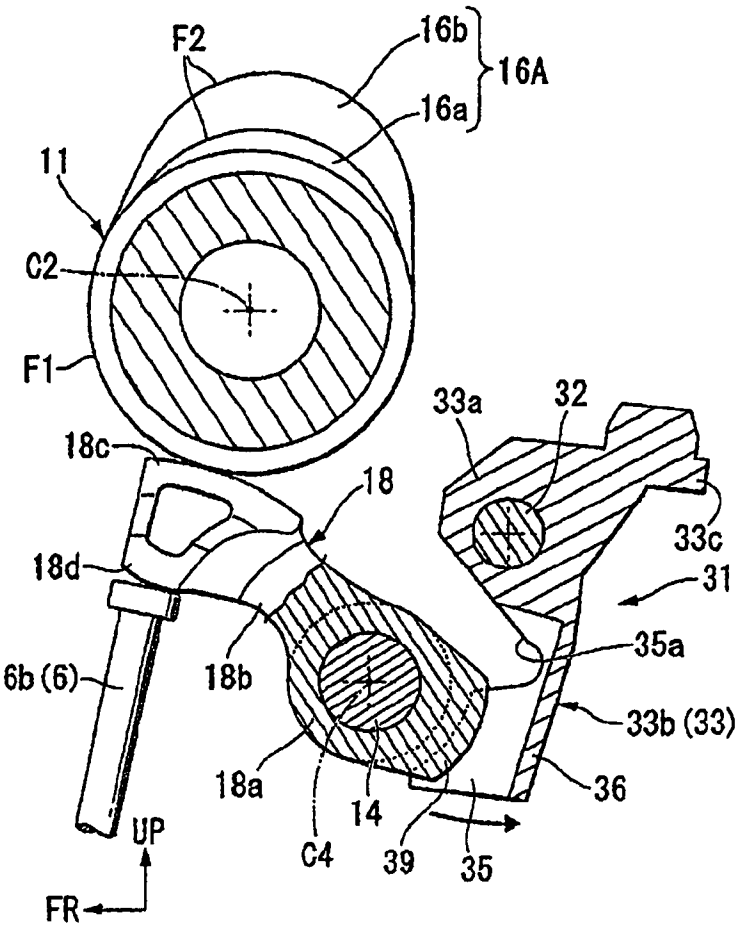
FIG. 10(*a*) is a cross-sectional view corresponding to FIG. 4(*a*) and showing the first manner of operation of the variable valve adjustment mechanism, and FIG. 10(*b*) is a cross-sectional view corresponding to FIG. 4(*b*) and showing the first manner of operation of the variable valve adjustment mechanism.
Figure 10A:
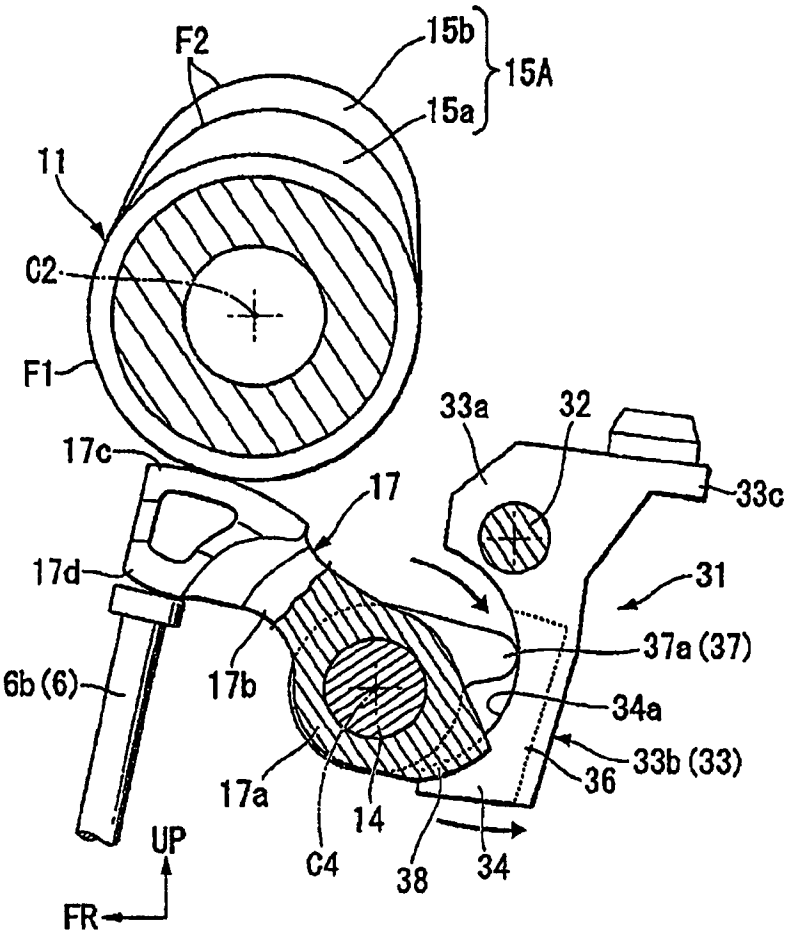

Along with the rotation of the rocker arm shaft 14, the center collar 37 is also rotated integrally (see FIG. 10(*a*)). Here, a position of the center collar 37 in the axial direction with respect to the rocker arm shaft 14 is changed depending on the combination of the central slot 14*a* and the engaging pin 37*d*.

Figure 9:
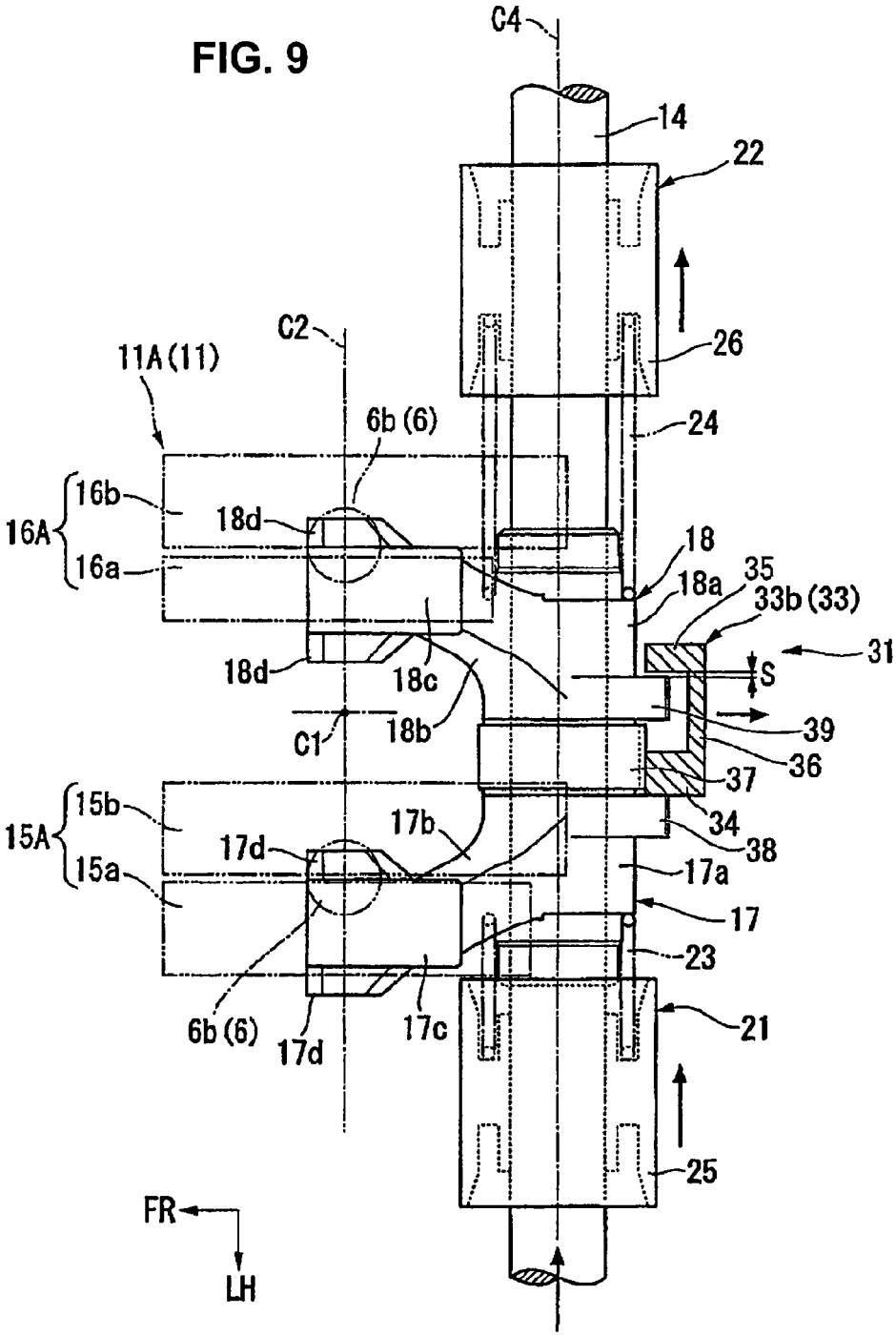
FIG. 9 is a top plan view corresponding to FIG. 2 and showing the first manner of operation of the variable valve adjustment mechanism.

Further, such that the left and right rocker arms 17, 18 are at the first operation position, to allow the first rocker arm moving mechanism 21 to store a predetermined force for moving the left and right rocker arms 17, 18 to the second operation position, first of all, as shown in FIG. 9, the shaft drive mechanism 41 is operated so as to move the rocker arm shaft 14 at the leftward-movement limit position in the rightward direction together with the respective spring-receiving collars 25, 26.

Here, since a lower portion of the left rocker-side key portion 38 of the left rocker arm 17 and a lower portion of the left trigger-side key portion 34 of the trigger arm 33 overlap each other with a predetermined overlapping quantity as viewed in the above-mentioned axial direction, the lower portion of the left rocker-side key portion 38 and the lower portion of the left trigger-side key portion 34 are brought into contact with each other in the axial direction so that the rightward-movement of the left and right rocker arms 17, 18 at the portions relative to the trigger arm 33 (cylinder head 2) is restricted.

Here, although a rear portion of the right rocker-side key portion 39 of the right rocker arm 18 and a lower portion of the right trigger-side key portion 35 of the trigger arm 33 overlap each other with a predetermined overlapping quantity as viewed in the axial direction, a predetermined gap S is defined between the rear portion of the right rocker-side key portion 39 and the lower portion of the right trigger-side key portion 35 in the axial direction.

To explain the above-mentioned arrangement also in conjunction with FIG. 10, the rocker arms shaft 14 is rotated in the clockwise direction shown in FIG. 10 and other drawings about an axis thereof along with the movement thereof in the rightward direction. When the center collar 37 is rotated in the clockwise direction shown in FIG. 10 and other drawings along with the rotation of the rocker arm shaft 14, an outer peripheral surface formed on a distal end of the center cam portion 37*a* is brought into slidable contact with an upper inner peripheral surface of a notched portion 34*a* of the left trigger-side key portion 34 of the trigger arm 33 in the above-mentioned pre-rocking state and hence, the trigger arm 33 is rotated in the counter clockwise direction shown in FIG. 10 and other drawings against a biasing force of the spring 33*d*.

Then, at a point of time that the rocker arm shaft 14 is moved to the above-mentioned rightward-movement limit position, and the rotation of the center collar 37 brought about by the movement of the rocker arm shaft 14 and the rotation of the trigger arm 33 brought about by the rotation of the center collar 37 are finished, the lower portion of the left rocker-side key portion 38 and the lower portion of the left trigger-side key portion 34 overlap each other while reducing an overlapping margin as viewed in the axial direction and, at the same time, the rear portion of the right rocker-side key portion 39 and the lower portion of the right trigger-side key portion 35 also assume an overlapping state while reducing an overlapping margin as viewed in the axial direction in the same manner. Here, a lower portion of the notched portion 35*a* of the right trigger-side key portion 35 assumes an arcuate shape substantially coaxial with the rocker arm shaft 14 as viewed in the axial direction. This state of the trigger arm 33 is referred to as a first rocking state of the trigger arm 33.

At a point of time that the rocker arm shaft 14 and the respective spring-receiving collars 25, 26 are moved to the rightward-movement limit position from the leftward-movement limit position as described above, the first spring 23 which is positioned between the first spring-receiving collar 25 and a proximal portion 17*a* of the left rocker arm 17 whose movement is restricted is compressed by a predetermined quantity and hence, the first spring 23 assumes a state in which a resilient force sufficient for moving the left and right rocker arms 17, 18 to the second operation position from the first operation position is stored in the first spring 23.

Figure 11B:
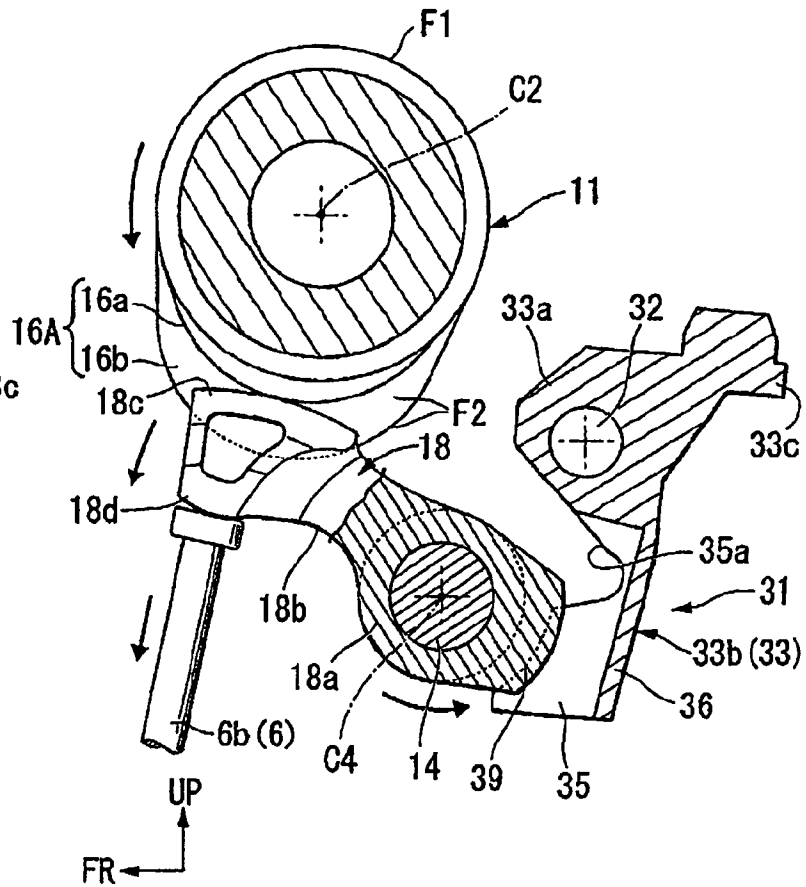
FIG. 11(*a*) is a cross-sectional view corresponding to FIG. 4(*a*) and showing the second manner of operation of the variable valve adjustment mechanism, and FIG. 11(*b*) is a cross-sectional view corresponding to FIG. 4(*b*) and showing the second manner of operation of the variable valve adjustment mechanism.
Figure 11A:
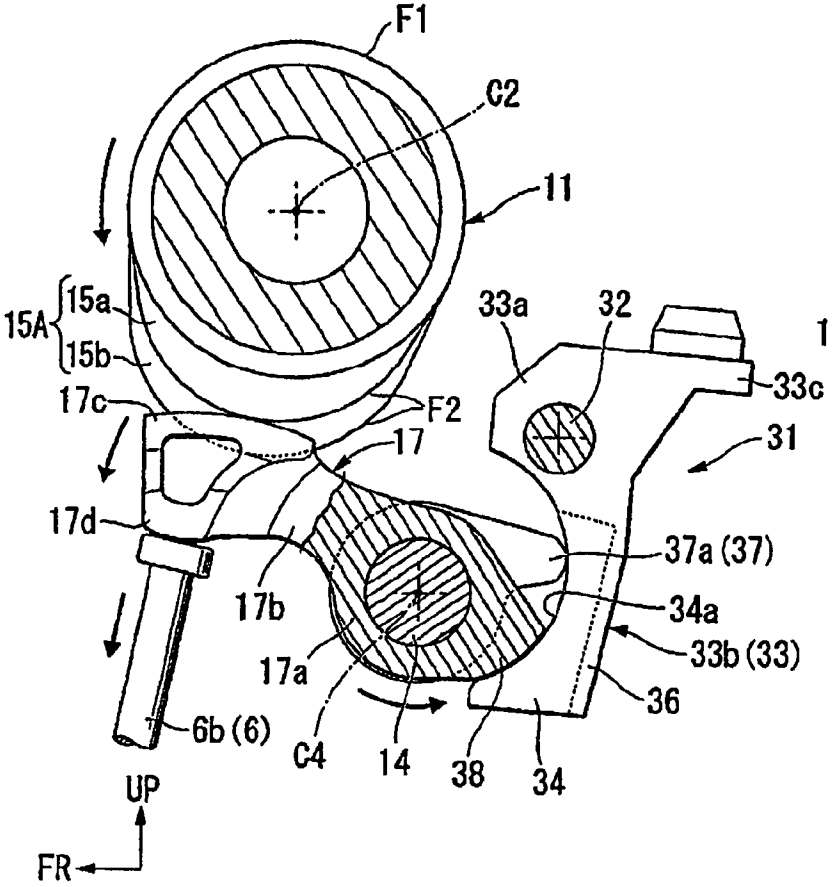

Then, assume that the left and right rocker arms 17, 18 are at the first operation position, the rocker arm shaft 14 is at the rightward-movement limit position, and the trigger arm 33 is in the above-mentioned first rocking state. As shown in FIG. 11, the left and right first cams 15*a*, 16*a* rock the left and right rocker arms 17, 18 to a valve opening side from a valve closing side by rotatably driving the intake-side cam shaft 11 (when the left and right cams 15*a*, 16*a* push the left and right rocker arms 17, 18 for lifting the left and right intake valves 6), for example, during a predetermined valve operation period which spans a point of time that the left and right intake valves 6 assume the maximum lift, an overlapping margin between the lower portion of the left rocker-side key portion 38 and the lower portion of the left trigger-side key portion 34 as viewed in the axial direction becomes 0 (the contact margin in the axial direction is eliminated) and hence, the restriction on the rightward-movement of the left and right rocker arms 17, 18 relative to the cylinder head 2 at the portions is removed.

Here, even when the left and right rocker arms 17, 18 are rocked when the trigger arm 33 assumes the above-mentioned pre-rocking state, the overlapping margin of the left rocker-side key portion 38 and the left trigger-side key portion 34 does not become 0. Accordingly, until the trigger arm 33 assumes the above-mentioned first rocking state (that is, until the first spring 23 acquires a predetermined force storing state), the restriction on the rightward movement of the left and right rocker arms 17, 18 are maintained.

Figure 12B:
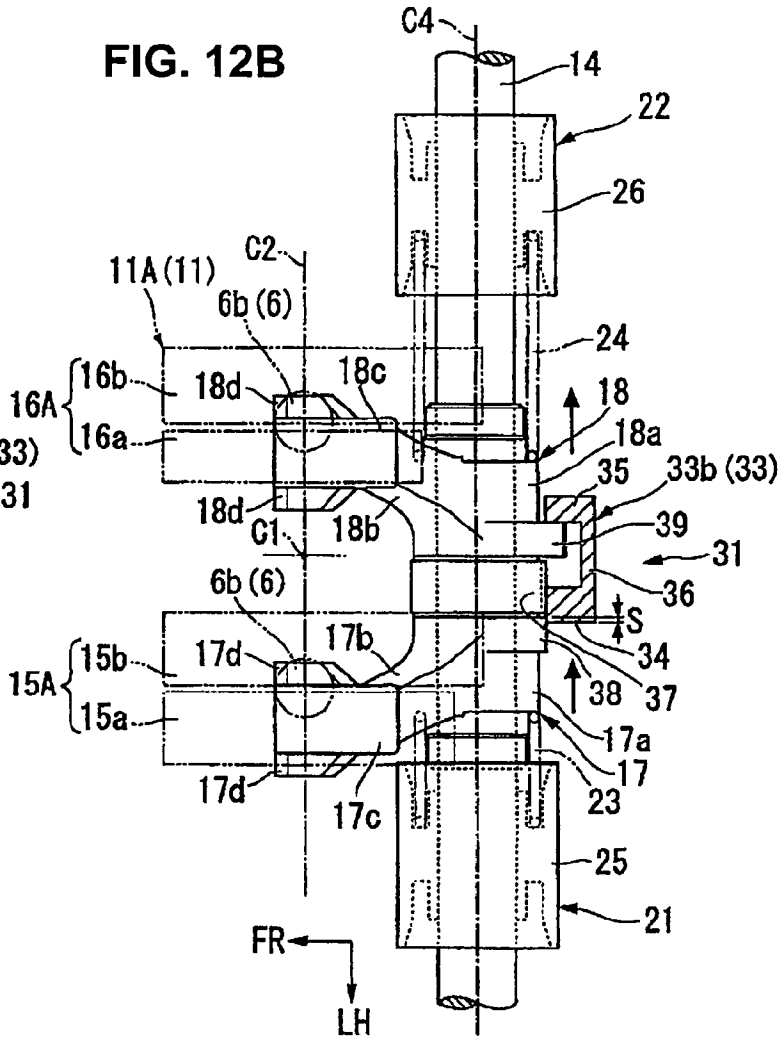
FIG. 12(*a*) is a top plan view corresponding to FIG. 2 and showing the second manner of operation of the variable valve adjustment mechanism, and FIG. 12(*b*) is a top plan view corresponding to FIG. 2 and showing the third manner of operation of the variable valve adjustment mechanism.
Figure 12A:
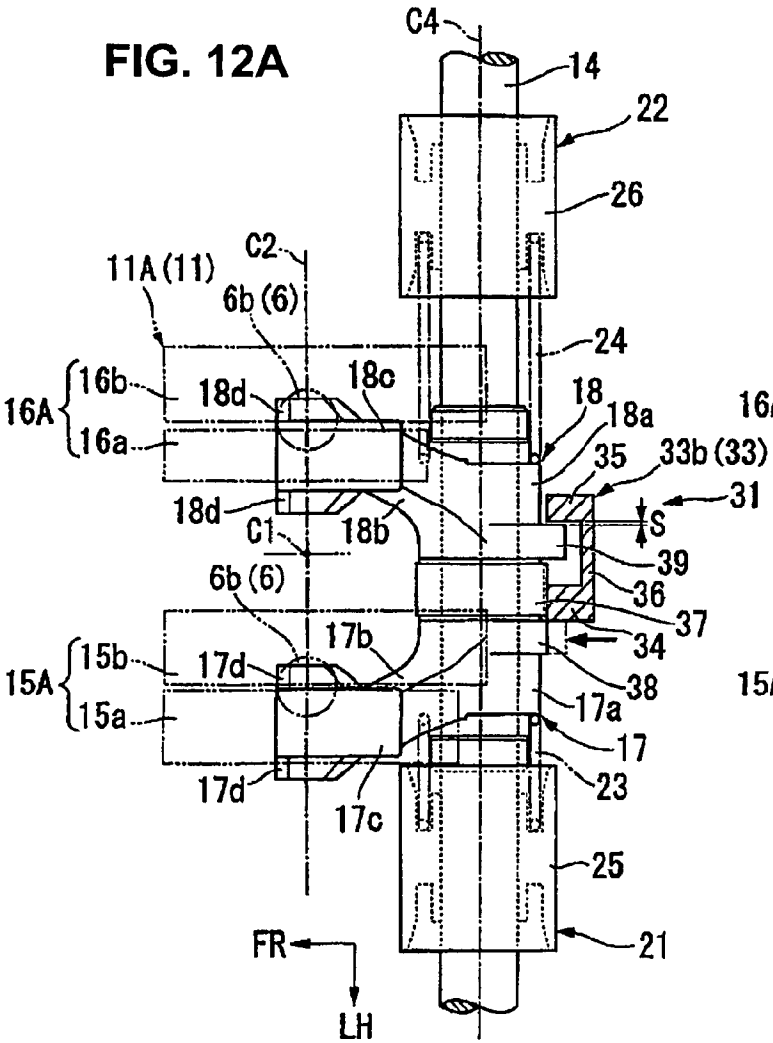

On the other hand, the overlapping margin of the rear portion of the right rocker-side key portion 39 and the lower portion of the right trigger-side key portion 35 as viewed in the axial direction is, since the above-mentioned portions are formed coaxially with the rocker arm shaft 14, hardly increased or decreased even when the left and right rocker arms 17, 18 rock. Accordingly, to explain the above-mentioned arrangement also in conjunction with FIG. 12, when the restriction on the rightward-movement of the left and right rocker arms 17, 18 between the left rocker-side key portion 38 and the left trigger-side key portion 34 is removed as described above, the left and right rocker arms 17, 18 (and the center collar 37) are moved in the rightward direction by a quantity corresponding to the above-mentioned gap S defined between the right rocker-side key portion 39 and the right trigger-side key portion 35.

Here, by bringing the rear portion of the right rocker-side key portion 39 and the lower portion of the right trigger-side key portion 35 into contact with each other in the axial direction, the rightward movement of the left and right rocker arms 17, 18 relative to the cylinder head 2 is restricted. Here, the lower portion of the left rocker-side key portion 38 and the lower portion of the left trigger-side key portion 34 overlap each other by a quantity corresponding to the above-mentioned gap S in the axial direction.

Figure 13B:
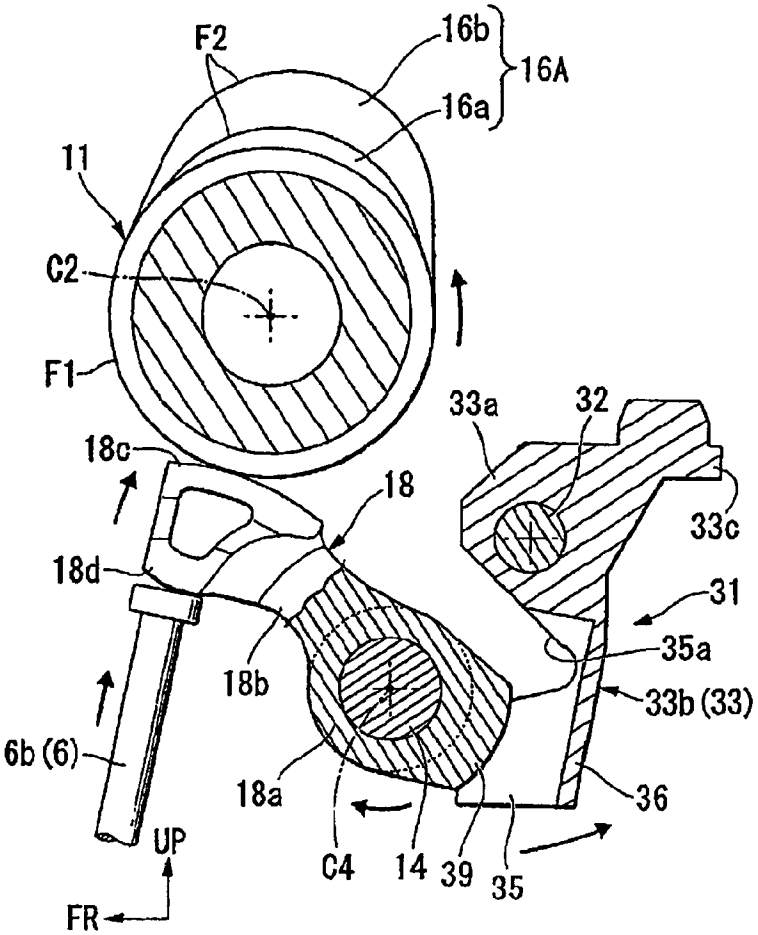
FIG. 13(*a*) is a cross-sectional view corresponding to FIG. 4(*a*) and showing the fourth manner of operation of the variable valve adjustment mechanism, and FIG. 13(*b*) is a cross-sectional view corresponding to FIG. 4(*b*) and showing the fourth manner of operation of the variable valve adjustment mechanism.
Figure 13A:
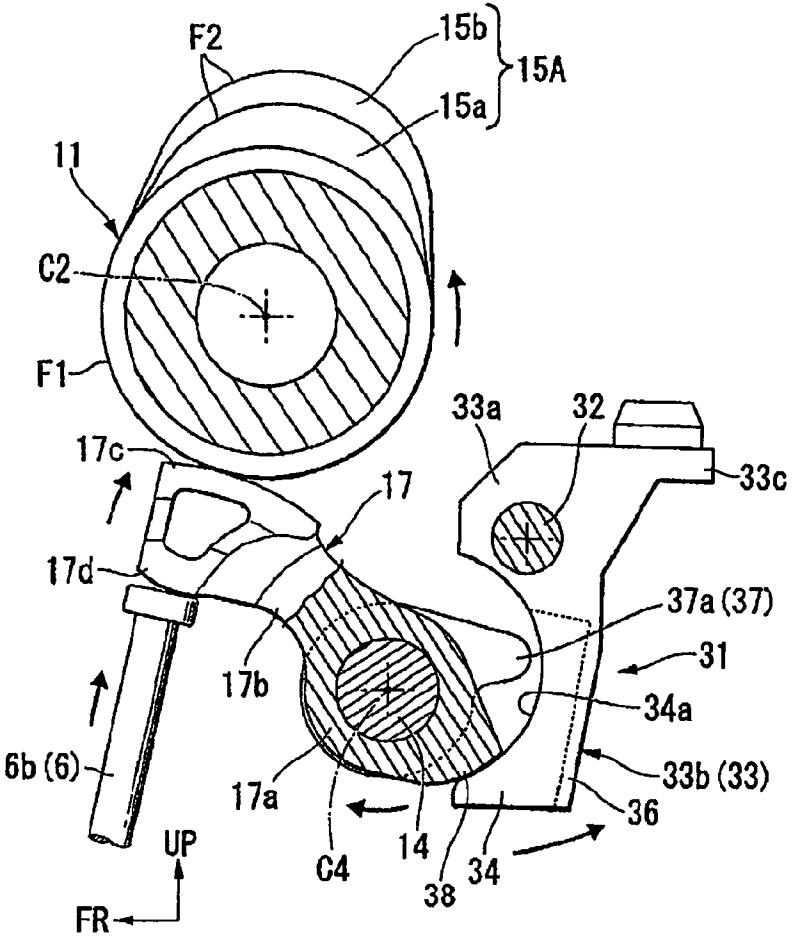

Then, such that the left rocker-side key portion 38 and the left trigger-side key portion 34 overlap each other by a predetermined overlapping quantity in the axial direction as described above, when the left and right rocker arms 17, 18 are rocked from a valve opening side to the valve closing side due to the continuous rotary driving of the intake-side cam shaft 11, as shown in FIG. 13, a lower outer peripheral surface of the left rocker-side key portion 38 is brought into slide contact with a lower inner peripheral surface of the notched portion 34*a* of the left trigger-side key portion 34 and hence, the trigger arm 33 is further rotated in the counter clockwise direction shown in FIG. 13 and other drawings from the above-mentioned first rocking state.

Figure 14B:
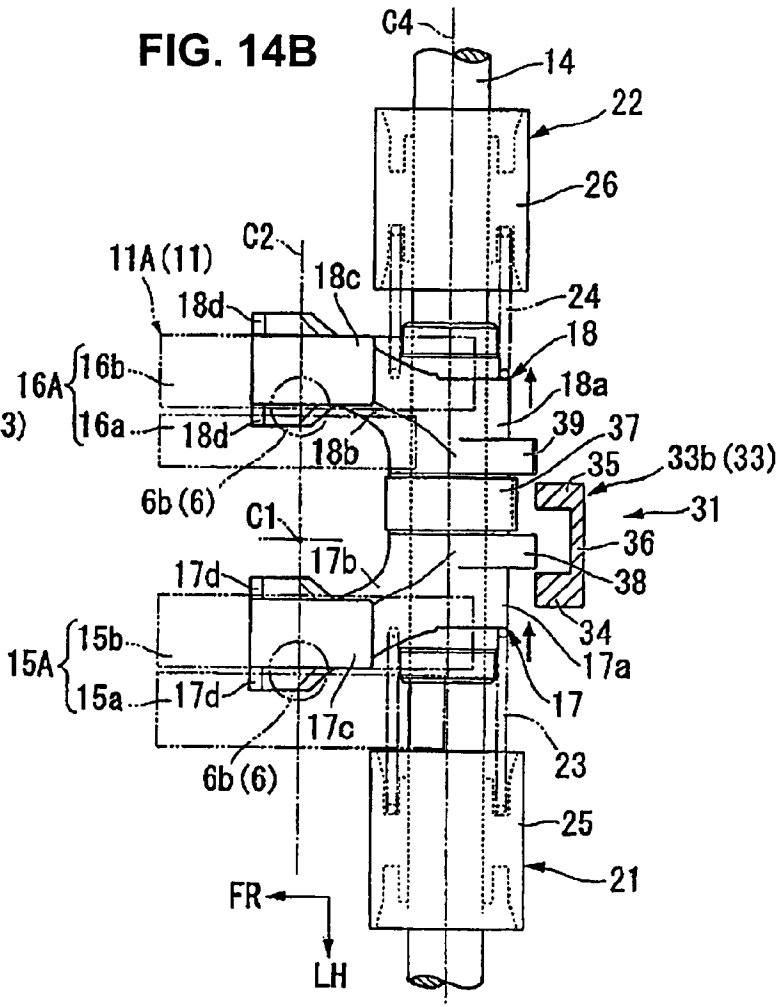
FIG. 14(*a*) is a top plan view corresponding to FIG. 2 and showing the fourth manner of operation of the variable valve adjustment mechanism, and FIG. 14(*b*) is a top plan view corresponding to FIG. 2 and showing the fifth manner of operation of the variable valve adjustment mechanism.
Figure 14A:
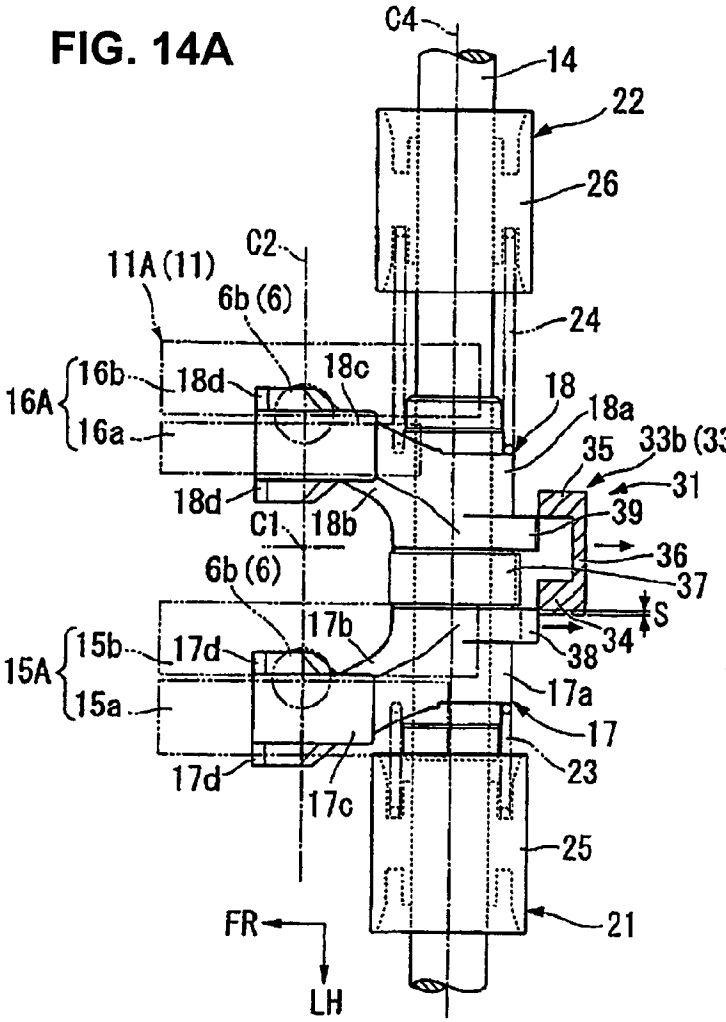

Further, to explain the above-mentioned arrangement also in conjunction with FIG. 14, at a point of time that the left and right rocker arms 17, 18 are rocked to a state in which a lift quantity of the intake valve 6 assumes 0 (valve full-closed state), an overlapping margin between a rear portion of the right rocker-side key portion 39 and a lower portion of the right trigger-side key portion 35 as viewed in the axial direction becomes 0 (a contact margin in the axial direction is eliminated) and hence, the restriction on the rightward-movement of the left and right rocker arms 17, 18 relative to the cylinder head 2 at the portions is removed.

Here, the restriction on the movement of the left and right rocker arms 17, 18 between the left rocker-side key portion 38 and the left trigger-side key portion 34 is also removed and hence, the left and right rocker arms 17, 18 (and the center collar 37) can be moved in the rightward direction whereby the left and right rocker arms 17, 18 are moved to the second operation position due to a resilient force stored in the first spring 23.

When the movement of the left and right rocker arms 17, 18 to the second operation position is completed, the left and right rocker-side key portions 38, 39 and the left and right trigger-side key portions 34, 35 no longer overlap each other in the axial direction respectively and hence, the trigger arm 33 is rotated in the clockwise direction shown in FIG. 13 and other drawings due to a biasing force of the spring 33*d* and returns to the above-mentioned pre-rocking state.

Figure 15:
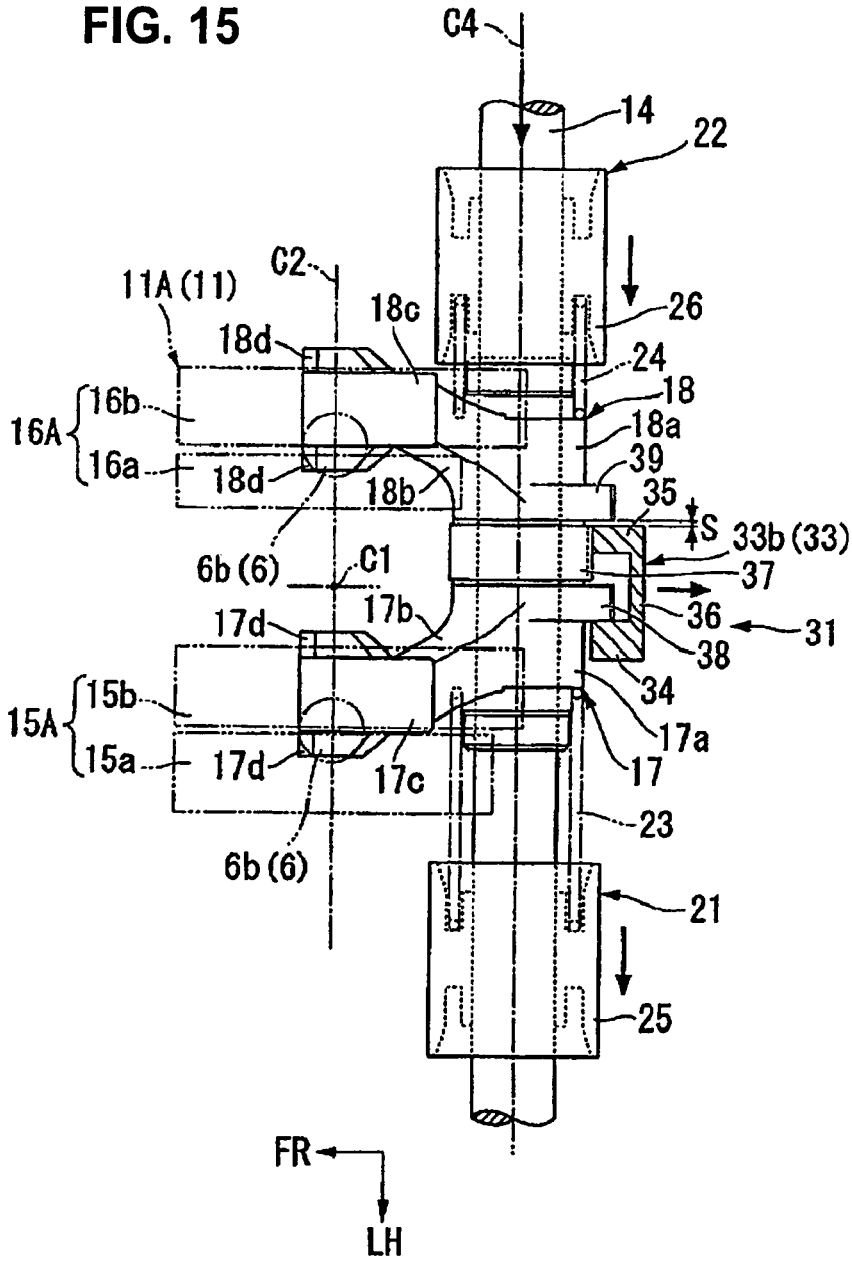
FIG. 15 is a top plan view corresponding to FIG. 3 and showing the sixth manner of operation of the variable valve adjustment mechanism.

Next, such that the left and right rocker arms 17, 18 are at the second operation position, to allow the second rocker arm moving mechanism 22 to store a predetermined force for moving the left and right rocker arms 17, 18 to the first operation position, first of all, as shown in FIG. 15, the shaft drive mechanism 41 is operated so as to move the rocker arm shaft 14 at the rightward-movement limit position in the leftward direction together with the respective spring-receiving collars 25, 26.

Here, since a lower portion of the left rocker-side key portion 38 of the left rocker arm 17 and a lower portion of the left trigger-side key portion 34 of the trigger arm 33 overlap each other with a predetermined overlapping quantity as viewed in the above-mentioned axial direction, the lower portion of the left rocker-side key portion 38 and the lower portion of the left trigger-side key portion 34 are brought into contact with each other in the axial direction so that the leftward-movement of the left and right rocker arms 17, 18 at the portions relative to the trigger arm 33 (cylinder head 2) is restricted.

Here, although a rear portion of right rocker-side key portion 39 of the right rocker arm 18 and a lower portion of the right trigger-side key portion 35 of the trigger arm 33 overlap each other with a predetermined overlapping quantity as viewed in the axial direction, the above-mentioned gap S is defined between the rear portion of the right rocker-side key portion 39 and the lower portion of the right trigger-side key portion 35.

Figure 16B:
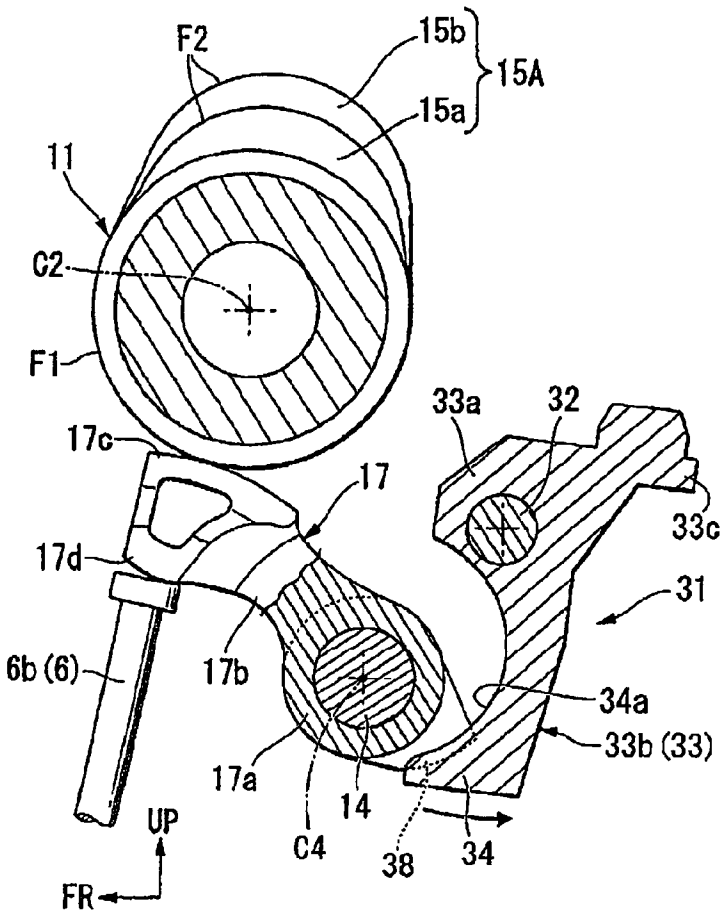
FIG. 16(*a*) is a cross-sectional view corresponding to FIG. 5(*a*) and showing the sixth manner of operation of the variable valve adjustment mechanism, and FIG. 16(*b*) is a cross-sectional view corresponding to FIG. 5(*b*) and showing the sixth manner of operation of the variable valve adjustment mechanism.
Figure 16A:
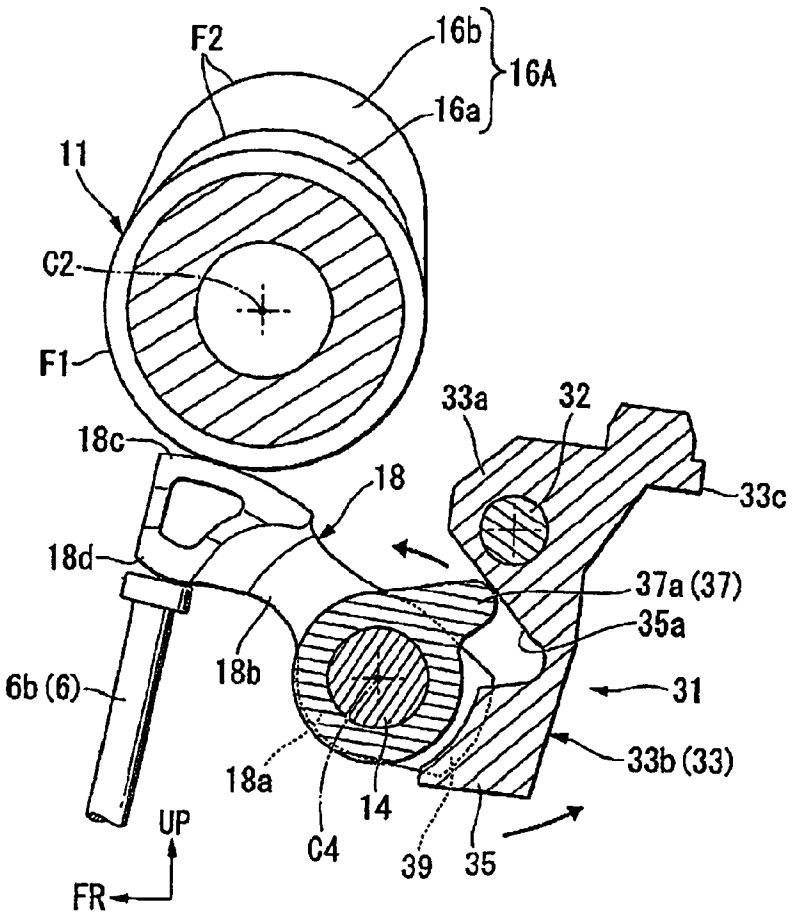

To explain the above-mentioned arrangement also in conjunction with FIG. 16, the rocker arms shaft 14 is rotated in the counter clockwise direction shown in FIG. 16 and other drawings about an axis thereof along with the movement thereof in the leftward direction. When the center collar 37 is rotated in the counter clockwise direction shown in FIG. 16 and other drawings along with the rotation of the rocker arm shaft 14, an outer peripheral surface formed on a distal end of the center cam portion 37*a* is brought into slidable contact with an upper inner peripheral surface of a notched portion 35*a* of the right trigger-side key portion 35 of the trigger arm 33 in the above-mentioned pre-rocking state and hence, the trigger arm 33 is rotated in the counter clockwise direction shown in FIG. 16 and other drawings against a biasing force of the spring 33*d*.

Then, at a point of time that the rocker arm shaft 14 is moved to the above-mentioned leftward-movement limit position, and the rotation of the center collar 37 brought about by the movement of the rocker arm shaft 14 and the rotation of the trigger arm 33 brought about by the rotation of the center collar 37 are finished, the lower portion of the left rocker-side key portion 38 and the lower portion of the left trigger-side key portion 34 overlap each other while reducing an overlapping margin as viewed in the axial direction and, at the same time, the rear portion of the right rocker-side key portion 39 and the rear portion of the right trigger-side key portion 35 also assume an overlapping state while reducing an overlapping margin as viewed in the axial direction in the same manner. Here, a lower portion of the notched portion 35*a* of the right trigger-side key portion 35 assumes an arcuate shape substantially coaxial with the rocker arm shaft 14 as viewed in the axial direction and hence, the trigger arm 33 assumes the above-mentioned first rocking state.

At a point of time that the rocker arm shaft 14 and the respective spring-receiving collars 25, 26 are moved to the leftward-movement limit position from the rightward-movement limit position as described above, the second spring 24 which is positioned between the second spring-receiving collar 26 and a proximal portion 18*a* of the right rocker arm 18 whose movement is restricted is compressed by a predetermined quantity and hence, the second spring 24 assumes a state in which a resilient force sufficient for moving the left and right rocker arms 17, 18 to the first operation position from the second operation position is stored in the second spring 24.

Figure 17B:
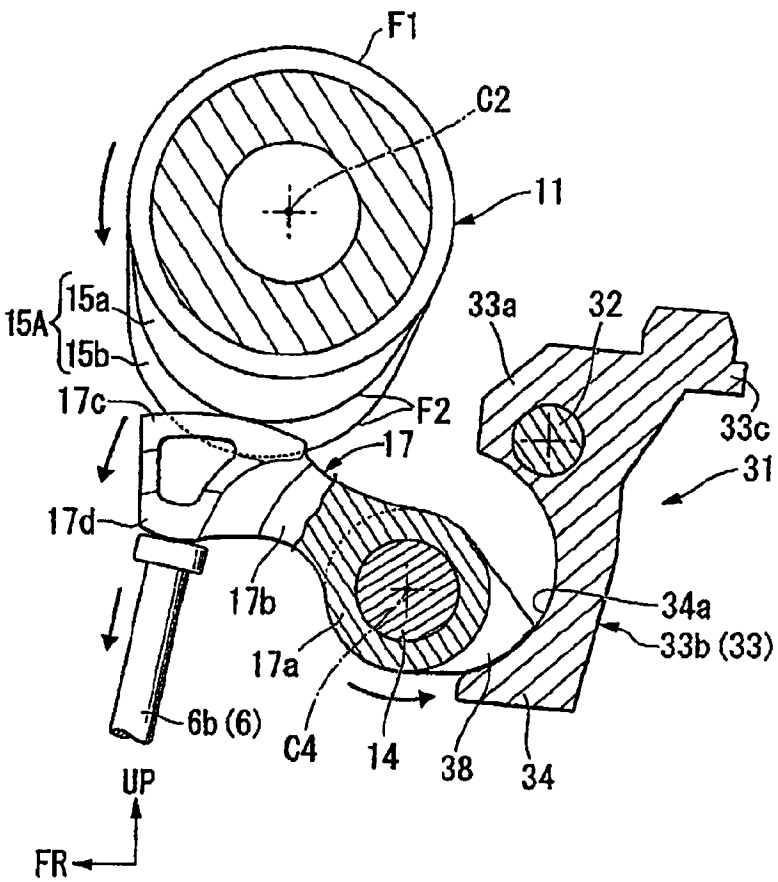
FIG. 17(*a*) is a cross-sectional view corresponding to FIG. 5(*a*) and showing the seventh manner of operation of the variable valve adjustment mechanism, and FIG. 17(*b*) is a cross-sectional view corresponding to FIG. 5(*b*) and showing the seventh manner of operation of the variable valve adjustment mechanism.
Figure 17A:
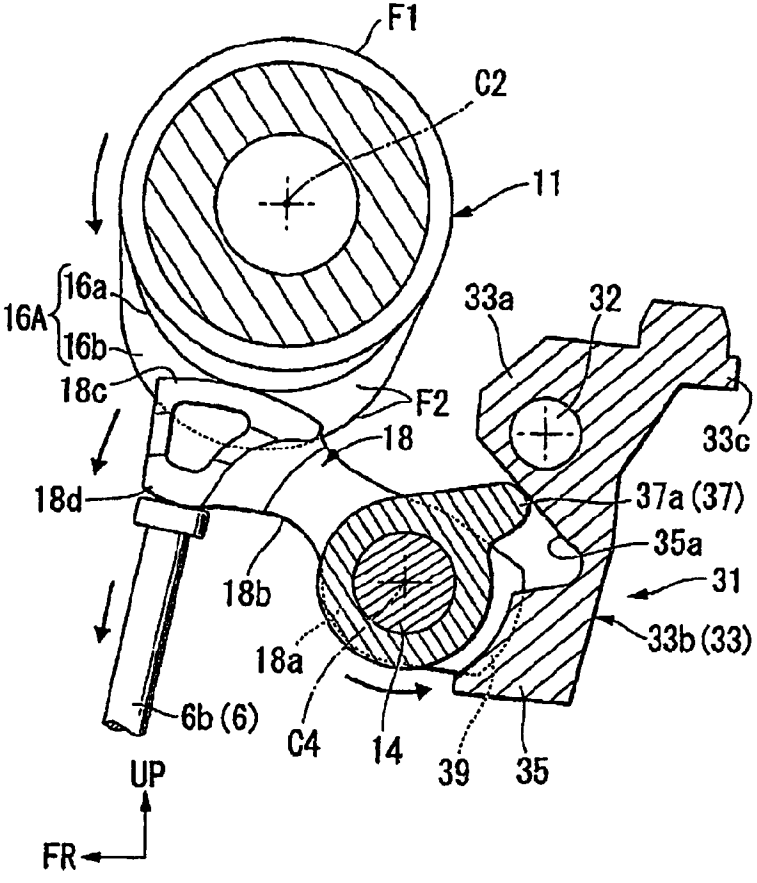

Then, assume that the left and right rocker arms 17, 18 are at the second operation position, the rocker arm shaft 14 is at the leftward-movement limit position, and the trigger arm 33 is in the above-mentioned first rocking state. As shown in FIG. 17, the left and right second cams 15*b*, 16*b* rock the left and right rocker arms 17, 18 to a valve opening side from a valve closing side by rotatably driving the intake-side cam shaft 11, for example, during a predetermined valve operation period which spans a point of time that the left and right intake valves 6 assume the maximum lift, an overlapping margin between the lower portion of the left rocker-side key portion 38 and the lower portion of the left trigger-side key portion 34 as viewed in the axial direction becomes 0 and hence, the restriction on the leftward-movement of the left and right rocker arms 17, 18 relative to the cylinder head 2 at the portions is removed.

Here, even when the left and right rocker arms 17, 18 are rocked when the trigger arm 33 assumes the above-mentioned pre-rocking state, the overlapping margin of the left rocker-side key portion 38 and the left trigger-side key portion 34 does not become 0. Accordingly, until the trigger arm 33 assumes the above-mentioned first rocking state (that is, until the second spring 24 acquires a predetermined force storing state), the restriction on the leftward movement of the left and right rocker arms 17, 18 is maintained.

Figure 18B:
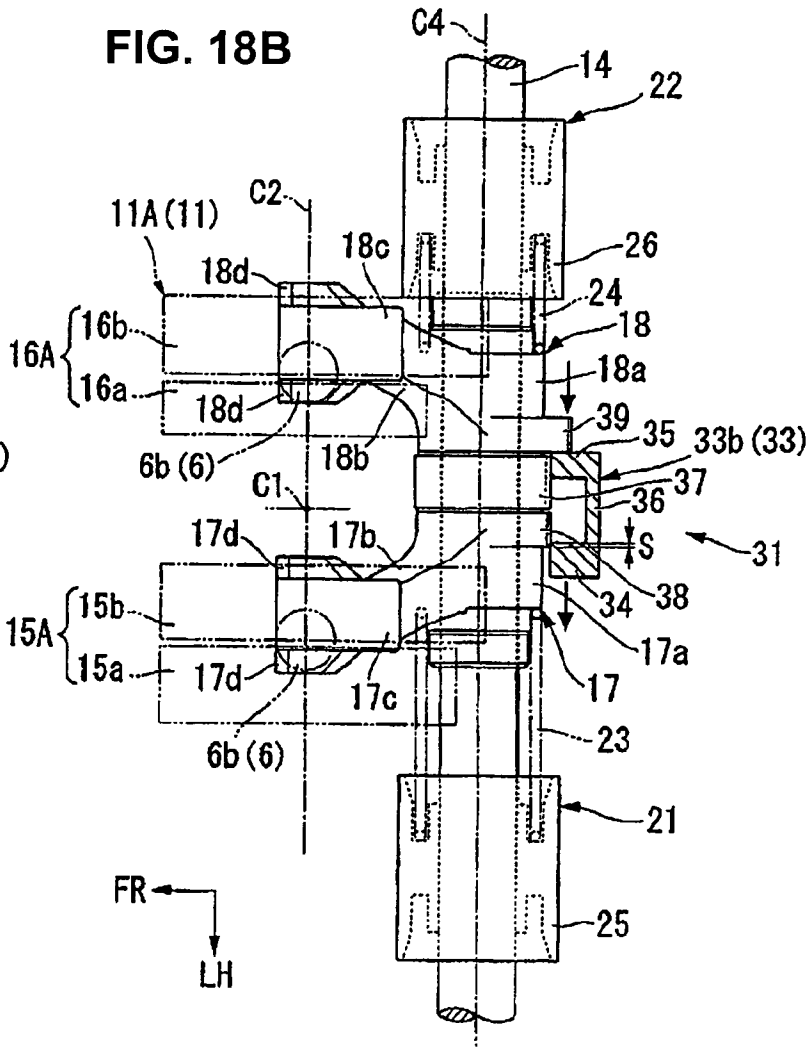
FIG. 18(*a*) is a top plan view corresponding to FIG. 3 and showing the seventh manner of operation of the variable valve adjustment mechanism, and FIG. 18(*b*) is a top plan view corresponding to FIG. 3 and showing the eighth manner of operation of the variable valve adjustment mechanism.
Figure 18A:
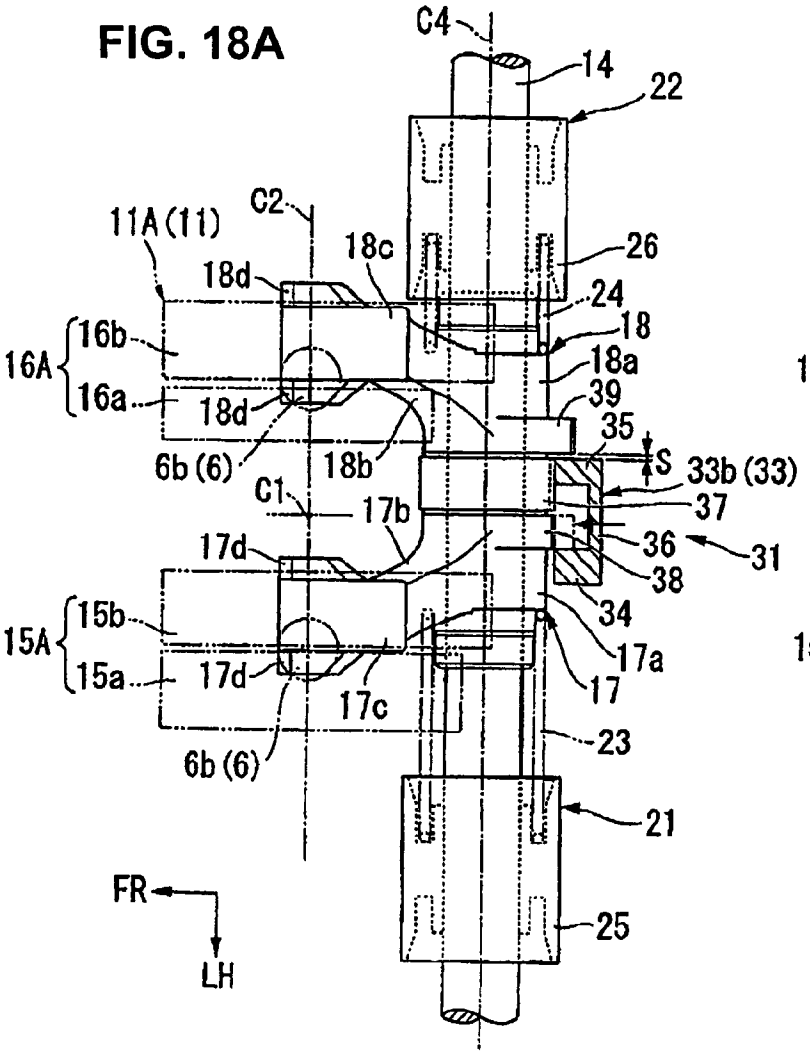

On the other hand, the overlapping margin of the rear portion of the right rocker-side key portion 39 and the lower portion of the right trigger-side key portion 35 as viewed in the axial direction is hardly increased or decreased even when the left and right rocker arms 17, 18 rock. Accordingly, to explain the above-mentioned arrangement also in conjunction with FIG. 18, when the restriction on the leftward-movement of the left and right rocker arms 17, 18 between the left rocker-side key portion 38 and the left trigger-side key portion 34 is removed as described above, the left and right rocker arms 17, 18 are moved in the leftward direction by a quantity corresponding to the above-mentioned gap S.

Here, by bringing the rear portion of the right rocker-side key portion 39 and the lower portion of the right trigger-side key portion 35 into contact with each other in the axial direction, the leftward movement of the left and right rocker arms 17, 18 relative to the cylinder head 2 is restricted. Here, the lower portion of the left rocker-side key portion 38 and the lower portion of the left trigger-side key portion 34 overlap each other by a quantity corresponding to the above-mentioned gap S in the axial direction.

Figure 19B:
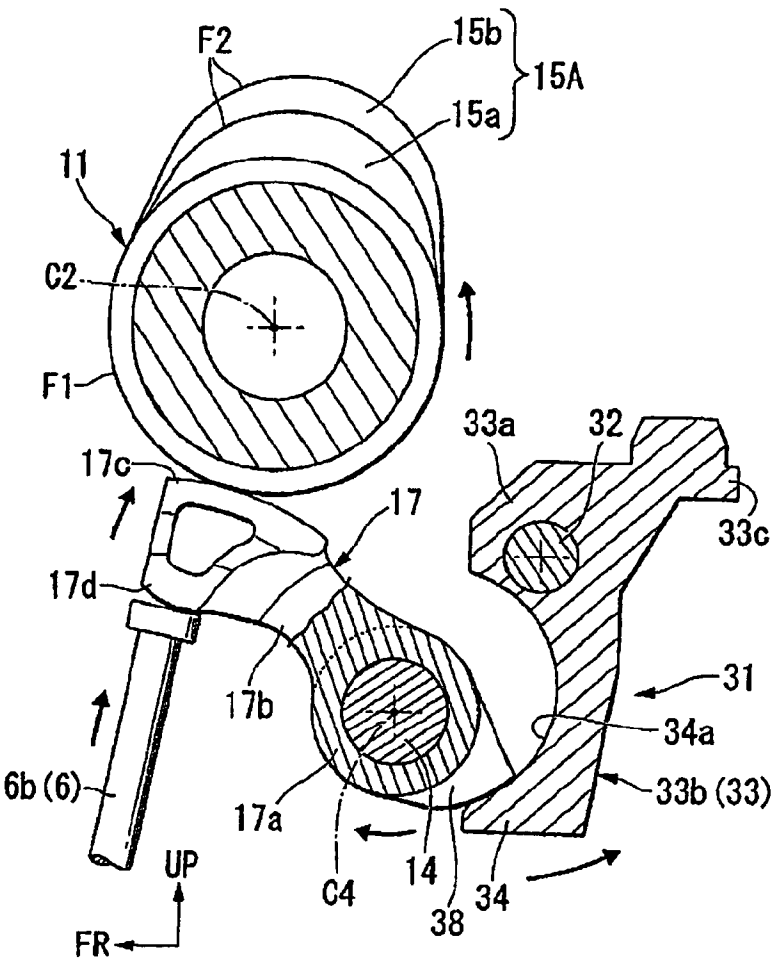
FIG. 19(*a*) is a cross-sectional view corresponding to FIG. 5(*a*) and showing the ninth manner of operation of the variable valve adjustment mechanism, and FIG. 19(*b*) is a cross-sectional view corresponding to FIG. 5(*b*) and showing the fifth manner of operation of the variable valve adjustment mechanism.
Figure 19A:
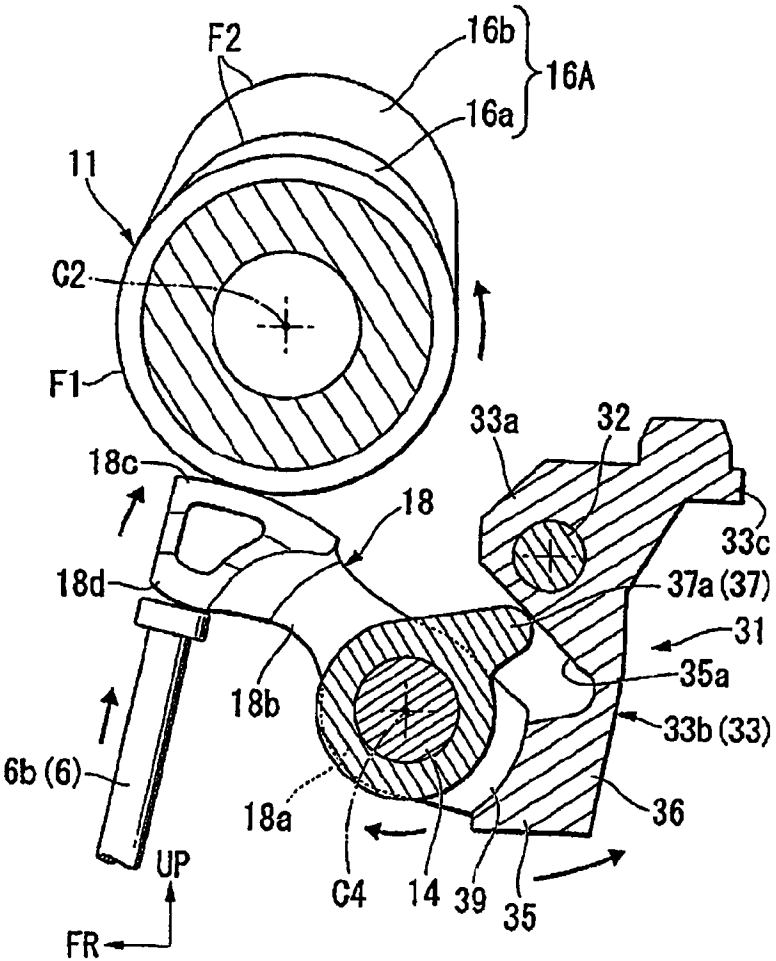

Then, such that the left rocker-side key portion 38 and the left trigger-side key portion 34 overlap each other by a predetermined overlapping quantity in the axial direction as described above, when the left and right rocker arms 17, 18 are rocked from a valve opening side to the valve closing side due to the continuous rotary driving of the intake-side cam shaft 11, as shown in FIG. 19, an outer peripheral surface of a lower portion of the left rocker-side key portion 38 is brought into slide contact with a lower inner peripheral surface of the notched portion 34*a* of the left trigger-side key portion 34 and hence, the trigger arm 33 is further rotated in the counter clockwise direction shown in FIG. 19 and other drawings from the above-mentioned first rocking state.

Figure 20B:
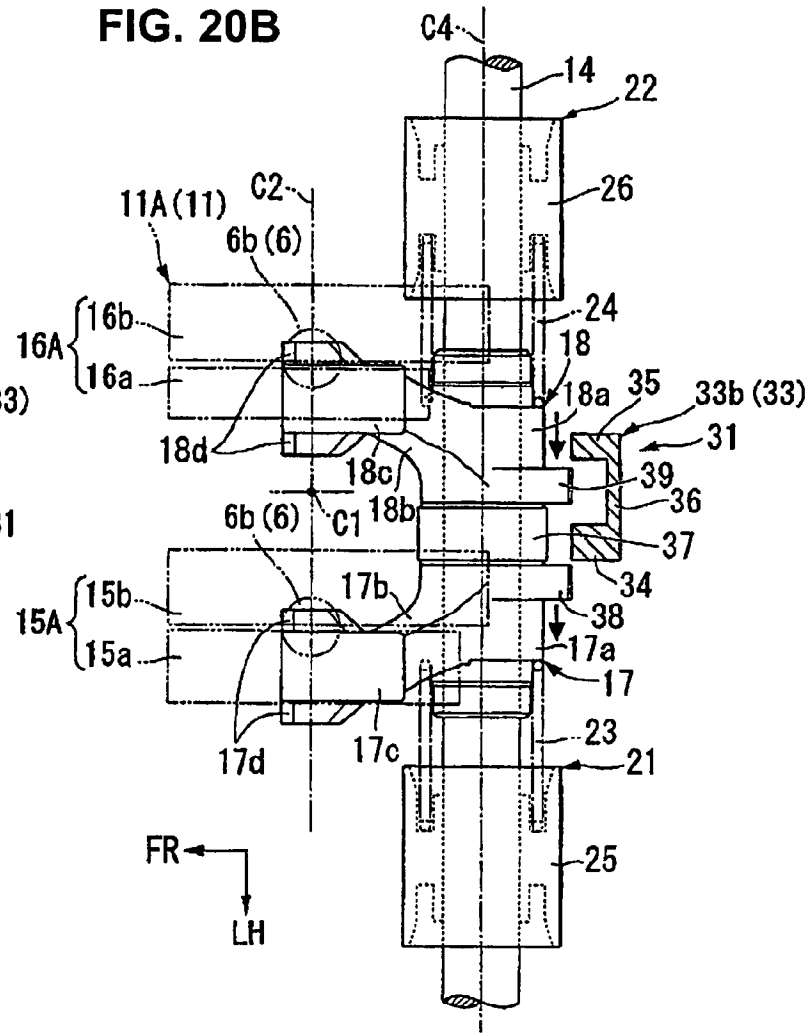
FIG. 20(*a*) is a top plan view corresponding to FIG. 3 and showing the ninth manner of operation of the variable valve adjustment mechanism, and FIG. 20(*b*) is a top plan view corresponding to FIG. 3 and showing the tenth manner of operation of the variable valve adjustment mechanism.
Figure 20A:
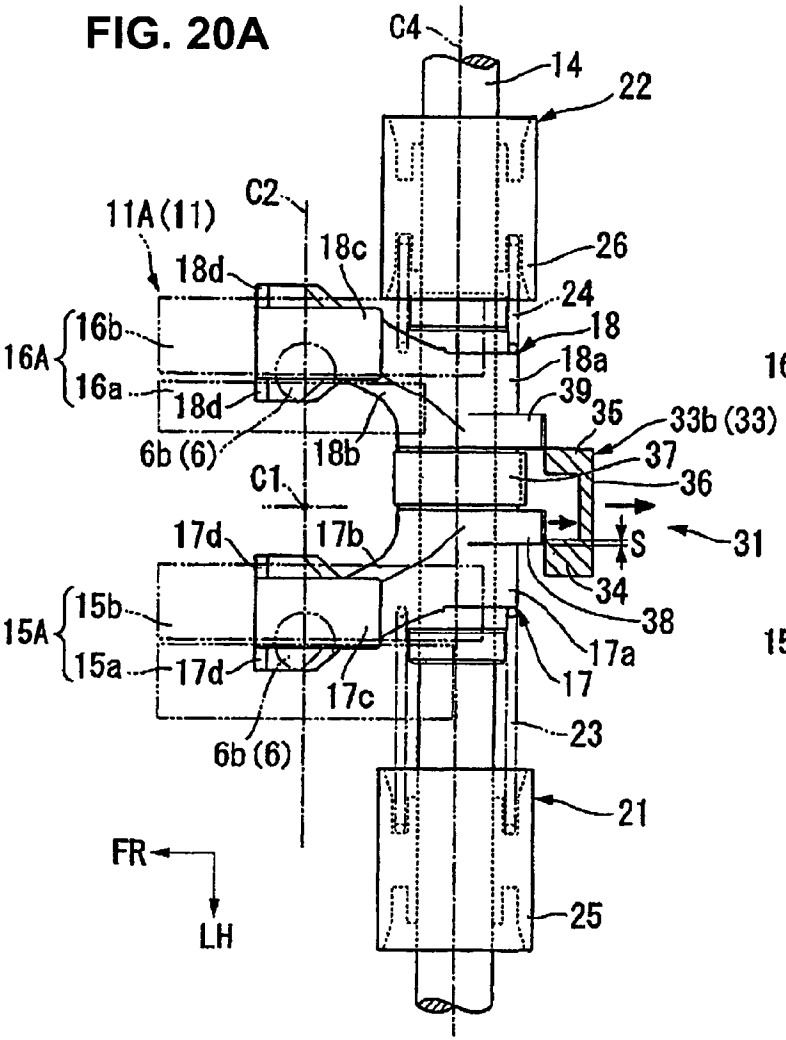

Further, to explain the above-mentioned arrangement also in conjunction with FIG. 20, at a point of time that the left and right rocker arms 17, 18 are rocked to a state in which a lift quantity of the intake valve 6 assumes 0, a rear portion of the right rocker-side key portion 39 and a lower portion of the right trigger-side key portion 35 overlap each other as viewed in the axial direction with an overlapping margin of 0 and hence, the restriction on the leftward-movement of the left and right rocker arms 17, 18 at the portions relative to the cylinder head 2 is removed.

Here, the restriction on the movement of the left and right rocker arms 17, 18 between the left rocker-side key portion 38 and the left trigger-side key portion 34 is also removed and hence, the left and right rocker arms 17, 18 (and the center collar 37) can be moved in the leftward direction whereby the left and right rocker arms 17, 18 are moved to the first operation position due to a resilient force stored in the second spring 24.

When the movement of the left and right rocker arms 17, 18 to the first operation position is completed, the left and right rocker-side key portions 38, 39 and the left and right trigger-side key portions 34, 35 no longer overlap each other in the axial direction respectively and hence, the trigger arm 33 is rotated in the clockwise direction shown in FIG. 19 and other drawings due to a biasing force of the spring 33*d* and returns to the above-mentioned pre-rocking state.

In this manner, by suitably changing (varying) the opening/closing timing or the valve lift quantity of the intake valve 6 depending on whether the rotational speed of the engine 1 (rotational speed of the crankshaft) is in a stop or a low-speed rotation range or in a high-speed rotation range, it is possible to reduce a valve overlapping quantity and to suppress a lift quantity in the low-speed rotation range of the engine 1, while it is possible to increase the valve overlapping quantity and the lift quantity in the high-speed rotation range of the engine 1. Here, it is needless to say that a valve variable mechanism similar to the above-mentioned valve variable mechanism may be also applied to an exhaust side of the engine 1. In this case, it is possible to realize efficient intake and exhaust operations at respective rotational ranges of the engine 1.

Figure 21:
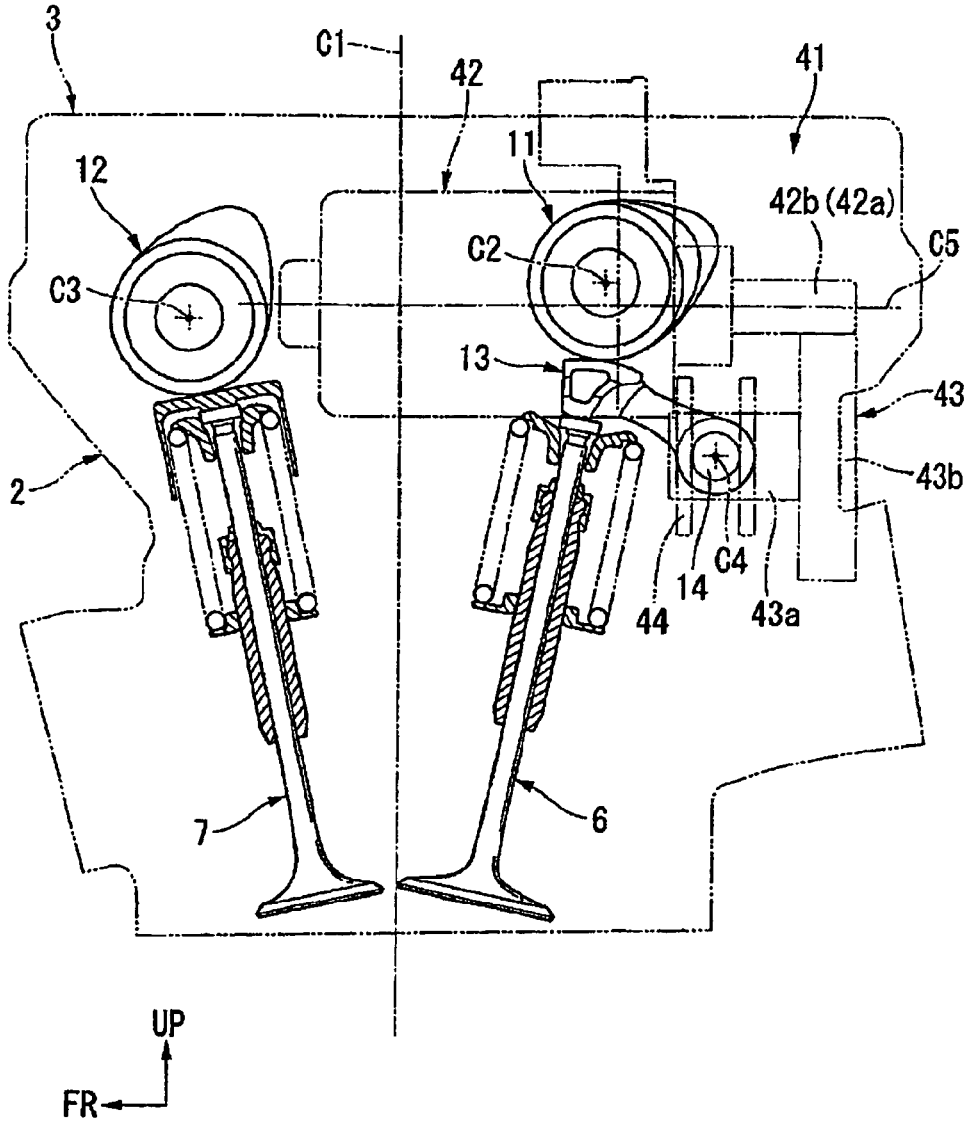
FIG. 21 is a left side view corresponding to FIG. 1 and showing a shaft drive mechanism of the variable valve adjustment mechanism.
Figure 22:
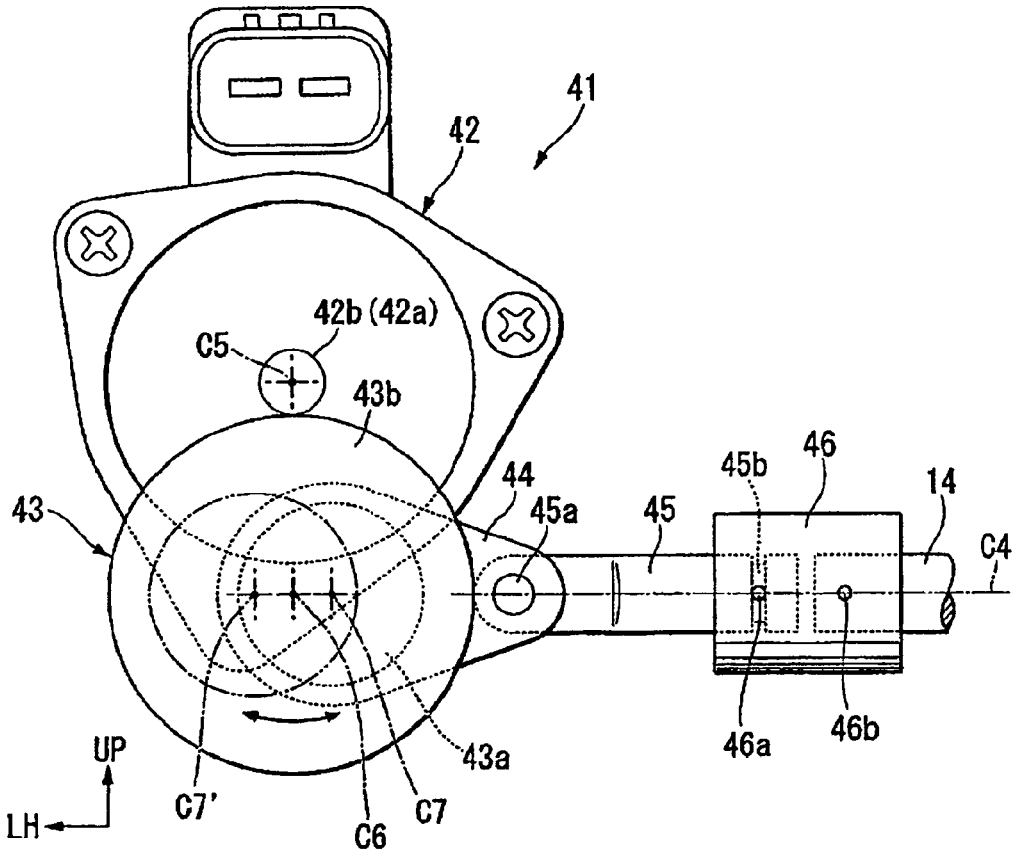
FIG. 22 is a rear surface view of an essential part of the shaft drive mechanism.

As shown in FIG. 21 and FIG. 22, the shaft drive mechanism 41 includes an electrically-operated motor 42 which comprises a drive source, a speed-reduction gear shaft 43 which is arranged parallel to a drive shaft 42*a* of the electrically-operated motor 42, and a connecting rod 44 which connects an eccentric shaft 43*a* of the speed-reduction gear shaft 43 and one end side of the rocker arm shaft 14.

The electrically-operated motor 42 is mounted on a left (or right)-side surface of the cylinder head 2, and is arranged to be orthogonal to a cylinder axis C1 when a drive shaft axis C5 is viewed in a side view. A drive gear 42*b* is formed on an outer periphery of the drive shaft 42*a* of the electrically operated motor 42, and the drive gear 42*b* is meshed with a large-diameter gear 43*b* mounted on one end side of the speed reduction gear shaft 43. A rotational drive force of the electrically-operated motor 42 is transmitted to the speed reduction gear shaft 43 with the speed reduction by way of the respective gears 42*b*, 43*b*, and the eccentric shaft 43*a* of the speed reduction gear shaft 43 is displaced laterally so as to allow the rocker arm shaft 14 to perform a stroke in the lateral direction (in the axial direction). Accordingly, a resilient force is stored in either one of the first rocker arm moving mechanism 21 and the second rocker arm moving mechanism 22. In FIG. 22, symbol C6 indicates a rotational center axis of the speed reduction gear shaft 43, symbol C7 indicates a center axis of the eccentric shaft 43*a* when the rocker arm shaft 14 is moved in the rightward direction, and symbol C7' indicates a center axis of the eccentric shaft 43*a* when the rocker arm shaft 14 is moved in the leftward direction.

Figure 23:
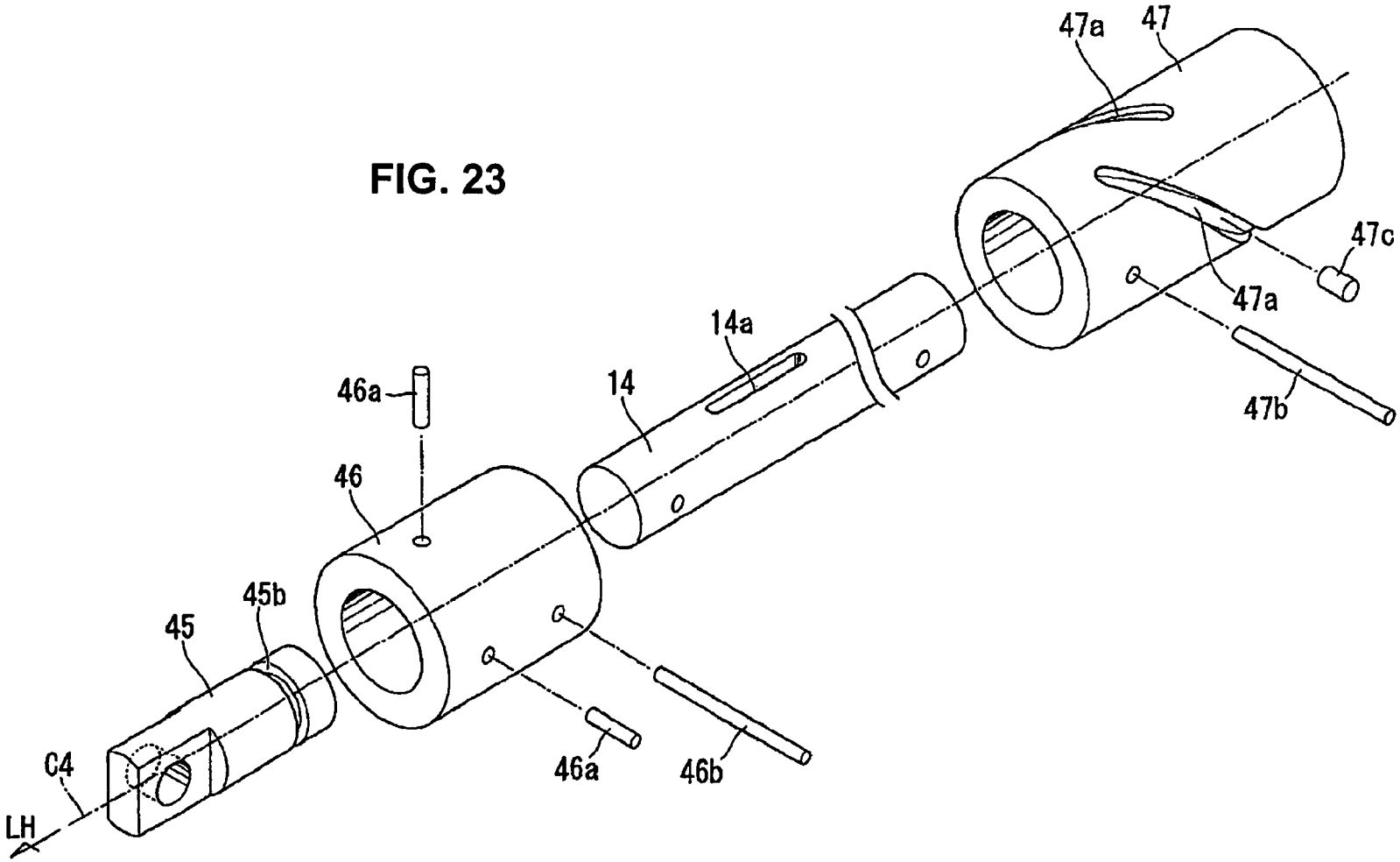
FIG. 23 is an exploded perspective view of the rocker arm shaft.

To explain the above-mentioned arrangement also in conjunction with FIG. 23, on one end portion of the rocker arm shaft 14, an end rod 45 coaxial with the rocker arm shaft 14 is mounted by way of an end collar 46. The end rod 45 has one end portion thereof rotatably connected to a distal end portion of the connecting rod 44 by way of a connecting pin 45*a* parallel to the eccentric shaft 43*a*, and has another end portion thereof held by the end collar 46 such that another end portion is not movable in the axial direction but is rotatable about an axis thereof.

The end collar 46 rotatably holds the end rod 45 about an axis thereof using a plurality of engaging pins 46*a*. On the other hand, one end portion of the rocker arm shaft 14 is fixedly held by the end collar 46 by way of a connecting pin 46*b* that penetrates the rocker arm shaft 14 and the end collar 46 in the radial direction. Here, in the drawing, symbol 45*b* indicates an engaging groove formed in an outer periphery of the end rod 45 that is engaged with engaging pins 46*a* formed on an inner periphery of the end collar 46 in a projecting manner. Further, the end collar 46 allows, in the same manner as the above-mentioned first spring-receiving collar 25, a left end portion of the first spring 23 to be fitted in a right-side inner periphery thereof. That is, the end collar 46 also functions as the first spring-receiving collar 25 of the left outer cylinder of the engine 1.

The rocker arm shaft 14 is formed of a single body that extends astride the respective cylinders of the engine 1. For example, on another end portion of the rocker arm shaft 14, a rotary collar 47 which forms a helical engaging groove 47*a* in an outer periphery thereof is fixedly mounted by way of a connecting pin 47*b* which penetrates the rocker arm shaft 14 and the rotary collar 47 in the radial direction.

The rotary collar 47 is inserted into and supported by a support hole not shown in the drawing that is formed in the cylinder head 2 such that the rotary collar 47 is rotatable about an axis thereof and is movable in the axial direction. An engaging pin 47*c* which projects toward an inner periphery of the above-mentioned support hole is suitably engaged with the engaging groove 47*a* formed in the rotary collar 47. Due to such a arrangement, when the rocker arm shaft 14 performs a stroke, in response to such a stroke, the end collar 46, the rocker arm shaft 14, the rotary collar 47, the first spring-receiving collar 25, and the second spring-receiving collar 26 are suitably rotated. The rotary collar 47 allows, in the same manner as the second spring-receiving collar 26, a right end portion of the second spring 24 to be fitted in the left-side inner periphery thereof. That is, the rotary collar 47 also functions as the second spring-receiving collar 24 in the right outer cylinder of the engine 1.

As has been explained heretofore, the valve actuating mechanism 5 of the engine 1 according to the above-mentioned embodiment includes the intake-side cam shaft 11 which includes the pair of first cams 15*a*, 16*a* and the second cams 15*b*, 16*b* for one intake valve 6, and the left and right rocker arms 17, 18 which are supported on the rocker arm shaft 14 which is arranged in parallel with the intake-side cam shaft 11 such that the left and right rocker arms 17, 18 are pivotally movable about the axis of the rocker arm shaft 14 and are movable in the axial direction of the rocker arm shaft 14, wherein the left and right rocker arms 17, 18 can be brought into contact with either one of the respective cams 15*a*, 16*a*, 15*b*, 16*b* in response to the rotational driving of the intake-side cam shaft 11 and are rocked to open or close the intake valve 6, and the left and right rocker arms 17, 18 are moved to either one of the first operation position at which the left and right rocker arms 17, 18 can be brought into contact with the first cams 15*a*, 16*a* in the axial direction and the second operation position at which the left and right rocker arms 17, 18 can be brought into contact with the second cams 15*b*, 16*b* in the axial direction thus allowing the valve actuating mechanism 5 to selectively use either one of the respective cams 15*a*, 16*a*, 15*b*, 16*b* for performing opening/closing operation of the intake valve 6. The valve actuating mechanism 5 having such a arrangement further includes the first rocker arm moving mechanism 21 including the first spring 23 which imparts the force to the left and right rocker arms 17, 18 for moving the left and right rocker arms 17, 18 from the first operation position side to the second operation position side, and the second rocker arm moving mechanism 22 including the second spring 24 which imparts the force to the left and right rocker arms 17, 18 for moving the left and right rocker arms 17, 18 from the second operation position side to the first operation position side, and after a predetermined force is stored in either one of the respective springs 23, 24, the left and right rocker arms 17, 18 are configured to be moved to the corresponding operation position using the predetermined force.

Due to such a arrangement, by moving the left and right rocker arms 17, 18 using the force which is stored in either one of the respective springs 23, 24, the movement of the left and right rocker arms 17, 18 is not influenced by an oil temperature or the like compared to a case that an engine oil pressure is used for moving the left and right rocker arms 17, 18 and hence, it is possible to stably and quickly move the left and right rocker arms 17, 18 whereby the valve driving cam can be quickly changed over. Further, it becomes unnecessary to provide an oil passage for supplying the oil pressure around the valve chamber 4 and hence, it is possible to simplify the valve actuating mechanism per se.

Further, the above-mentioned valve actuating mechanism 5 is configured such that, for restricting the movement of the left and right rocker arms 17, 18 in the axial direction until the predetermined force is stored in either one of the respective springs 23, 24, the valve actuating mechanism 5 includes the rocker arm moving restriction mechanism 31 which includes the trigger arm 33 which is engaged with the left and right rocker arms 17, 18 for restricting the movement of the left and right rocker arms 17, 18 in the axial direction, and the center collar 37 which removes the engagement between the trigger arm 33 and the left and right rocker arms 17, 18 by operating the trigger arm 33.

Due to such a arrangement, there exists no possibility that the left and right rocker arms 17, 18 are moved before either one of the respective springs 23, 24 stores the predetermined force and hence, it is possible to quickly and accurately move the left and right rocker arms 17, 18 using the force which is stored in either one of the respective springs 23, 24.

Further, the above-mentioned valve actuating mechanism 5 is configured such that the respective springs 23, 24 are compression coil springs which are wrapped around the outer periphery of the rocker arm shaft 14, and one ends of the respective springs 23, 24 are engaged with the left and right proximal portions 17*a*, 18*a* of the left and right rocker arms 17, 18 through which the rocker arm shaft 14 penetrates.

Due to such a arrangement, the forces are imparted to the left and right proximal portions 17*a*, 18*a* of the left and right rocker arms 17, 18 through which the rocker arm shaft 14 penetrates from the respective springs 23, 24 and hence, it is possible to smoothly move the left and right rocker arms 17, 18 in the axial direction. Further, it becomes unnecessary to provide engaging portions for the respective springs 23, 24 to the arm portions 17*b*, 18*b* or the like of the left and right rocker arms 17, 18 additionally and hence, the miniaturization and the reduction of weight of the left and right arms 17, 18 and eventually the valve actuating mechanism per se can be realized.

Here, the present invention is not limited to the above-mentioned embodiment. For example, the present invention may adopt the arrangement which restricts the operation of the rocker arm by the respective rocker arm moving mechanisms 21, 22 until the respective springs 23, 24 acquire a predetermined force storing state without using the trigger arm 33 for restricting the movement of the rocker arm. Further, the present invention may adopt the arrangement that stores the force in the respective springs 23, 24 by suitably moving only the respective spring-receiving collars 25, 26 without moving the rocker arm shaft 14 in the axial direction. Further, the respective springs 23, 24 may be formed of a tensile or torsional coil spring or a leaf spring, or may be formed of a resilient material other than metal. Still further, the present invention may adopt the arrangement that, without moving the rocker arm in two stages, moves the rocker arm between the respective operation positions at a stroke when recessed portions and projecting portions of the respective key portions are aligned or engaged with each other.

Further, the engine to which the present invention is applied is not limited to a 4-valve-type engine, and may be a 2-valve-type or a 3-valve-type engine, and may adopt a single rocker arm that cannot perform relative rocking at intake and exhaust sides of one cylinder. Further, the engine to which the present invention is applied is not limited to a DOHC engine but may be an OHC or OHV engine. Further, the engine to which the present invention is applied may be a parallel plural cylinder engine other than the 4-cylinder engine, a single-cylinder engine, or various types of reciprocating engines such as a V-type plural-cylinder engine.

The embodiments of the present invention have been described as above. The present invention is not limited to the above embodiments, but various design changes can be made without departing from the present invention as described in the claims.

What is claimed is:

1. A valve actuating mechanism for an engine, said valve actuating mechanism comprising:

a cylinder head having a plurality of valves mounted therein for reciprocal movement thereof;

a camshaft rotatably mounted in the cylinder head, the camshaft including a first cam and a second cam for selective alternating use in operation of one of the valves;

a rocker arm which is supported on a rocker arm shaft which is arranged in parallel with the cam shaft such that the rocker arm is pivotally movable about an axis of the rocker arm shaft and is movable in the axial direction of the rocker arm shaft;

wherein the rocker arm is operable to selectively contact one of the respective cams in response to rotational movement of the camshaft, and is configured to be rocked to open or close the valve;

the rocker arm being movable to a first operation position at which the rocker arm can be brought into contact with the first cam in the axial direction or to a second operation position at which the rocker arm can be brought into contact with the second cam in the axial direction thus allowing the valve actuating mechanism to selectively use either one of the respective cams for performing opening/closing operation of the valve;

the valve actuating mechanism further includes a first rocker arm moving mechanism having a first spring which imparts a biasing force to the rocker arm for moving the rocker arm from the first operation position side to the second operation position side, a second rocker arm moving mechanism having a second spring which imparts a biasing force to the rocker arm for moving the rocker arm from the second operation position side to the first operation position side, and a rocker arm moving restriction mechanism which restricts the movement of the rocker arm in the axial direction until the force is stored in either one of the respective springs;

wherein the valve actuating mechanism is configured to store a force in either one of the respective springs such that the rocker arm may be moved to the corresponding operation position using the stored force, and wherein the rocker arm and the rocker arm moving restriction mechanism overlap each other with a predetermined overlapping quantity, as viewed in the axial direction, and are brought into contact with each other in the axial direction.

2. A valve actuating mechanism for an engine according to claim 1, wherein the rocker arm moving restriction mechanism includes a trigger member which is engaged with the rocker arm for restricting the movement of the rocker arm in the axial direction, and a cam member which operates the trigger member so as to remove the engagement of the trigger member with the rocker arm.

3. A valve actuating mechanism for an engine according to claim 1, wherein the respective springs are coil springs which are wrapped around an outer periphery of the rocker arm shaft, and one ends of the respective springs are engaged with a proximal portion of the rocker arm through which the rocker arm shaft penetrates.

4. The valve actuating mechanism of claim 3, wherein the first rocker arm moving mechanism includes a first spring which is positioned on a left side of the proximal portion of the left rocker arm and applies a biasing force directed to the second operation position side from the first operation position side to the proximal portion, and a first spring-receiving collar which is positioned on a left side of the first spring and is supported on an outer periphery of the rocker arm shaft such that the first spring-receiving collar is not movable in the axial direction relative to the rocker arm shaft.

5. The valve actuating mechanism of claim 4, wherein the second rocker arm moving mechanism includes a second spring which is positioned on a right side of the proximal portion of the right rocker arm and applies a biasing force directed to the first operation position side from the second operation position side to the proximal portion, and a second spring-receiving collar which is positioned on a right side of the second spring and is supported on the outer periphery of the rocker arm shaft such that the second spring-receiving collar is not movable in the axial direction relative to the rocker arm shaft.

6. The valve actuating mechanism of claim 2, wherein the cam member comprises a center collar which is supported on the rocker arm shaft between the proximal portions of the left and right rocker arms such that the center collar is fixed about the axis of the rocker arm shaft and is relatively movable in the axial direction of the rocker arm shaft.

7. The valve actuating mechanism of claim 6, wherein the collar is supported on the rocker arm shaft such that the center collar is fixed about the axis of the rocker arm shaft and is movable in the axial direction of the rocker arm shaft by a quantity corresponding to a length of the slit hole.

8. The valve actuating mechanism of claim 7, wherein the rocker arm shaft is a one-piece construction.

9. The valve actuating mechanism of claim 8, wherein a shaft drive mechanism is operated so as to move the rocker arm shaft with the respective spring-receiving collars.

10. The valve actuating mechanism of claim 9, wherein the drive mechanism comprises an electrically-operated motor mounted on the cylinder head, rotational drive force of the electrically-operated motor is transmitted to so as to allow the rocker arm shaft to perform a stroke to store a biasing force in either one of the first rocker arm moving mechanism and the second rocker arm moving mechanism.

11. The valve actuating mechanism of claim 10, wherein the drive mechanism further comprises on one end portion of the rocker arm shaft, an end rod coaxial with the rocker arm shaft mounted by way of an end collar, the end rod has one end portion thereof rotatably connected to a distal end portion of a connecting rod by a connecting pin and has the other end portion thereof held by the end collar such that the other end portion is not movable in the axial direction but is rotatable about an axis thereof.

12. The valve actuating mechanism of claim 11, wherein end collar rotatably holds the end rod about an axis thereof using a plurality of engaging pins;

one end portion of the rocker arm shaft is fixedly held by the end collar by way of a connecting pin that penetrates the rocker arm shaft and the end collar;

an engaging groove formed in an outer periphery of the end rod that is engaged with engaging pins; and the end collar also functions as the first spring-receiving collar.

13. The valve actuating mechanism of claim 12, wherein on another end portion of the rocker arm shaft, a rotary collar is fixedly mounted by way of a connecting pin which penetrates the rocker arm shaft and the rotary collar in the radial direction.

14. The valve actuating mechanism of claim 13, wherein the rotary collar includes a helical engaging groove formed therein in an outer periphery thereof.

15. The valve actuating mechanism of claim 14, wherein the rotary collar is rotatable about an axis thereof and is movable in the axial direction.

16. The valve actuating mechanism of claim 15, wherein when the rocker arm shaft performs a stroke, the end collar, the rocker arm shaft, the rotary collar, the first spring-receiving collar, and the second spring-receiving collar are rotated.

17. The valve actuating mechanism of claim 16, wherein the rotary collar has a right end portion of the second spring fitted in the left-side inner periphery thereof such that the rotary collar functions as the second spring-receiving collar.

18. In an engine of the type having at least one cylinder and at least one intake valve and at least one exhaust valve, each valve having a valve spring, the improvement comprising a valve actuating mechanism for selectively using one of a pair of cams on a camshaft for actuation of one of said valves, depending on a rotary speed of the engine, the valve actuating mechanism comprising:

a camshaft which includes a pair of first and second cams for each valve of the engine;

a rocker arm which is supported on a rocker arm shaft which is arranged in parallel with the camshaft such that the rocker arm is pivotally movable about an axis of the rocker arm shaft and the rocker arm are movable in the axial direction on the rocker arm shaft;

wherein during engine operation, the rocker arm contacts one of the respective cams in response to rotational movement of the camshaft and is rocked to open or close the valve;

the rocker arm moving to one of a first operation position at which the rocker arm can be brought into contact with a first cam and a second operation position at which the rocker arm can be brought into contact with a second cam thus allowing the valve actuating mechanism to selectively use either one of the respective cams for opening/closing operation of the valve;

the valve actuating mechanism further includes a first rocker arm moving mechanism having a first spring which imparts a biasing force to the rocker arm for moving the rocker arm from the first operation position to the second operation position, a second rocker arm moving mechanism having a second spring which imparts a biasing force to the rocker arm for moving the rocker arm from the second operation position to the first operation position, and a rocker arm moving restriction mechanism which restricts the movement of the rocker arm in the axial direction until the force is stored in either one of the respective springs; and a biasing force stored in either one of the respective springs such that the rocker arm is moved to the operation position, wherein the rocker arm and the rocker arm moving restriction mechanism overlap each other with a predetermined overlapping quantity, as viewed in the axial direction, and are brought into contact with each other in the axial direction.

19. A valve actuating mechanism for an engine, comprising:

a cam shaft which includes a pair of first and second cams for one valve; and a rocker arm which is supported on a rocker arm shaft which is arranged in parallel with the cam shaft in a state that the rocker arm is rockable about an axis of the rocker arm shaft and is movable in the axial direction of the rocker arm shaft, wherein the rocker arm is brought into contact with either one of the respective cams in response to the rotational driving of the cam shaft and is rocked to open or close the valve, and the rocker arm is moved to either one of a first operation position at which the rocker arm can be brought into contact with the first cam in the axial direction and a second operation position at which the rocker arm can be brought into contact with the second cam in the axial direction thus allowing the valve mechanism to selectively use either one of the respective cams for performing opening/closing operation of the valve, the improvement being characterized in that the valve mechanism further includes a first rocker arm moving mechanism having a first spring which imparts a biasing force to the rocker arm for moving the rocker arm from the first operation position side to the second operation position side, a second rocker arm moving mechanism having a second spring which imparts a biasing force to the rocker arm for moving the rocker arm from the second operation position side to the first operation position side, and a rocker arm moving restriction mechanism which restricts the movement of the rocker arm in the axial direction until the force is stored in either one of the respective springs, and after a predetermined force is stored in either one of the respective springs, the rocker arm is configured to be moved to the corresponding operation position using the force, wherein the rocker arm and the rocker arm moving restriction mechanism overlap each other with a predetermined overlapping quantity, as viewed in the axial direction, and are brought into contact with each other in the axial direction.

* * * * *